US011663949B2

(12) United States Patent
Lai et al.

(10) Patent No.: US 11,663,949 B2
(45) **Date of Patent: *May 30, 2023**

(54) DISPLAY PANEL AND DISPLAY DEVICE

(71) Applicant: Xiamen Tianma Micro-Electronics Co., Ltd., Xiamen (CN)

(72) Inventors: Qingjun Lai, Xiamen (CN); Yihua Zhu, Xiamen (CN)

(73) Assignee: XIAMEN TIANMA MICRO-ELECTRONICS CO., LTD, Xiamen (CN)

( * ) Notice: Subject to any disclaimer, the term of this patent is extended or adjusted under 35 U.S.C. 154(b) by 0 days.

This patent is subject to a terminal disclaimer.

(21) Appl. No.: 17/856,751

(22) Filed: Jul. 1, 2022

(65) Prior Publication Data

US 2022/0335875 A1 Oct. 20, 2022

Related U.S. Application Data

(63) Continuation of application No. 17/451,235, filed on Oct. 18, 2021, now Pat. No. 11,410,590.

(30) Foreign Application Priority Data

Jan. 8, 2021 (CN) ..... 202110024241.X

(51) Int. Cl.
*G09G 3/20* (2006.01)

(52) U.S. Cl.
CPC ..... *G09G 3/20* (2013.01); *G09G 2300/043* (2013.01); *G09G 2300/0426* (2013.01); *G09G 2300/0819* (2013.01); *G09G 2310/0286* (2013.01)

(58) Field of Classification Search
CPC ..... G09G 3/3266; G09G 2310/0286; G09G 2300/0426
See application file for complete search history.

(56) References Cited

U.S. PATENT DOCUMENTS

| | | | |
|---|---|---|---|
| 2014/0146031 | A1 | 5/2014 | Lee et al. |
| 2020/0027516 | A1 | 1/2020 | Feng et al. |
| 2021/0201806 | A1 | 7/2021 | Feng et al. |
| 2021/0335202 | A1 | 10/2021 | Feng et al. |

FOREIGN PATENT DOCUMENTS

| | | | |
|---|---|---|---|
| CN | 107424649 | A | 12/2017 |

*Primary Examiner* — Van N Chow
(74) *Attorney, Agent, or Firm* — Anova Law Group PLLC

(57) ABSTRACT

A display panel and a display device are provided. The display panel includes a driving circuit, and the driving circuit includes N-level shift registers cascaded with each other, where N is greater than or equal to two. A shift register of the N-level shift registers includes: a third control unit, configured to control a signal of a fourth node, the third control unit receives a first voltage signal and a second voltage signal, the first voltage signal is a high-level signal, and the second voltage signal is a low-level signal; and a fourth control unit, configured to generate an output signal, the fourth control unit receives a third voltage signal and a fourth voltage signal, and the third voltage signal is a high-level signal, and the fourth voltage signal is a low-level signal.

20 Claims, 16 Drawing Sheets

DISPLAY PANEL AND DISPLAY DEVICE

CROSS-REFERENCE TO RELATED APPLICATION

This application is a continuation application of U.S. patent application Ser. No. 17/451,235, filed on Oct. 18, 2021, which claims the priority of Chinese patent application No. 202110024241.X, filed on Jan. 8, 2021, the entirety of which is incorporated herein by reference.

FIELD

The present disclosure generally relates to the field of display technology and, more particularly, relates to a display panel and a display device.

BACKGROUND

At present, display technology has been widely used in the display of a televisions, a mobile phone and public information, which brings great convenience to people's daily life and work. In the prior art, a scan driving circuit is required to provide a driving signal to a pixel circuit in a display panel for displaying an image, to control the display panel to achieve the scanning function, such that an image data inputted to the display panel may be refreshed in real time, to achieve a dynamic display.

However, the existing scan driving circuit cannot meet the demands of the pixel circuit for different signals with different voltages. The disclosed display panel and display device are directed to solve one or more problems set forth above and other problems.

SUMMARY

One aspect of the present disclosure provides a display panel. The display panel includes a driving circuit, and the driving circuit includes N-level shift registers cascaded with each other, where N is greater than or equal to two. A shift register of the N-level shift registers includes: a third control unit, configured to control a signal of a fourth node, the third control unit receives a first voltage signal and a second voltage signal, the first voltage signal is a high-level signal, and the second voltage signal is a low-level signal; and a fourth control unit, configured to generate an output signal, the fourth control unit receives a third voltage signal and a fourth voltage signal, and the third voltage signal is a high-level signal, and the fourth voltage signal is a low-level signal.

Another aspect of the present disclosure provides a display device. The display device includes a display panel. The display panel includes a driving circuit, and the driving circuit includes N-level shift registers cascaded with each other, where N is greater than or equal to two. A shift register of the N-level shift registers includes: a third control unit, configured to control a signal of a fourth node, the third control unit receives a first voltage signal and a second voltage signal, the first voltage signal is a high-level signal, and the second voltage signal is a low-level signal; and a fourth control unit, configured to generate an output signal, the fourth control unit receives a third voltage signal and a fourth voltage signal, and the third voltage signal is a high-level signal, and the fourth voltage signal is a low-level signal.

Other aspects of the present disclosure can be understood by those skilled in the art in light of the description, the claims, and the drawings of the present disclosure.

BRIEF DESCRIPTION OF THE DRAWINGS

To more clearly illustrate the embodiments of the present disclosure, the drawings will be briefly described below. The drawings in the following description are certain embodiments of the present disclosure, and other drawings may be obtained by a person of ordinary skill in the art in view of the drawings provided without creative efforts.

DETAILED DESCRIPTION OF THE DISCLOSURE

Reference will now be made in detail to exemplary embodiments of the disclosure, which are illustrated in the accompanying drawings. Wherever possible, the same reference numbers will be used throughout the drawings to refer to the same or the alike parts. The described embodiments are some but not all of the embodiments of the present disclosure. Based on the disclosed embodiments, persons of ordinary skill in the art may derive other embodiments consistent with the present disclosure, all of which are within the scope of the present disclosure.

Similar reference numbers and letters represent similar terms in the following Figures, such that once an item is defined in one Figure, it does not need to be further discussed in subsequent Figures.

Figure 1:
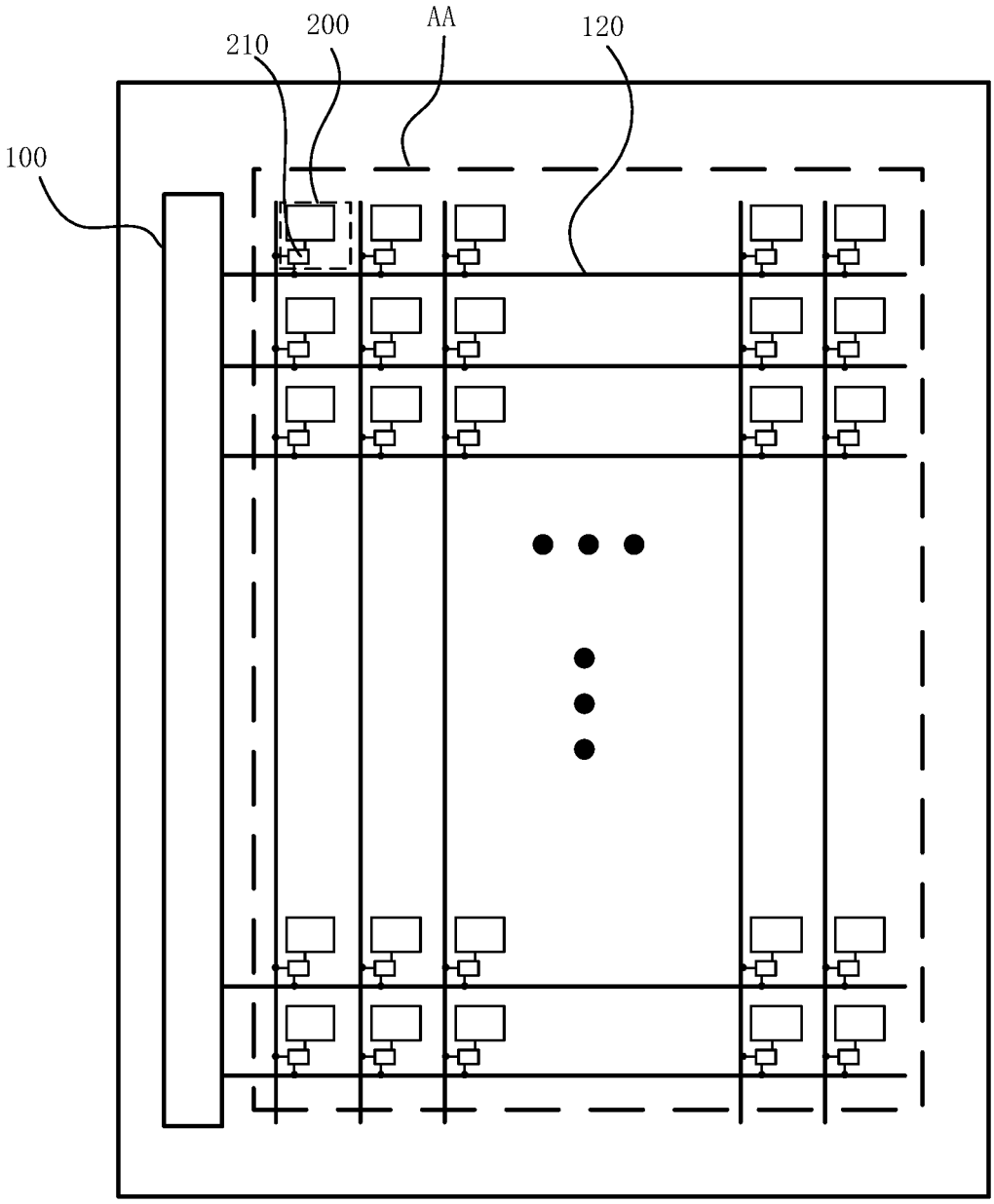
FIG. 1 illustrates a schematic top-view of an exemplary display panel consistent with disclosed embodiments of the present disclosure.

The present disclosure provides a display panel and a display device. FIG. 1 illustrates a schematic top-view of a display panel consistent with disclosed embodiments of the present disclosure. Referring to FIG. 1, the display panel may include a driving circuit 100 and a plurality of pixels 200. Each pixel 200 may be provided with a pixel circuit 210. The driving circuit 100 may be connected to the pixel circuit 210 through a signal line to provide a driving signal to the pixel circuit 210, such that the pixel circuit 210 may drive the pixel 200 to emit light to display an image.

It should be noted that FIG. 1 merely illustrates a structure of a display panel as an example, where the driving circuit 100 may be disposed on a side of the display panel. In certain embodiments, the driving circuit 100 may be disposed on both sides of the display panel, which may not be repeated herein.

Figure 2:
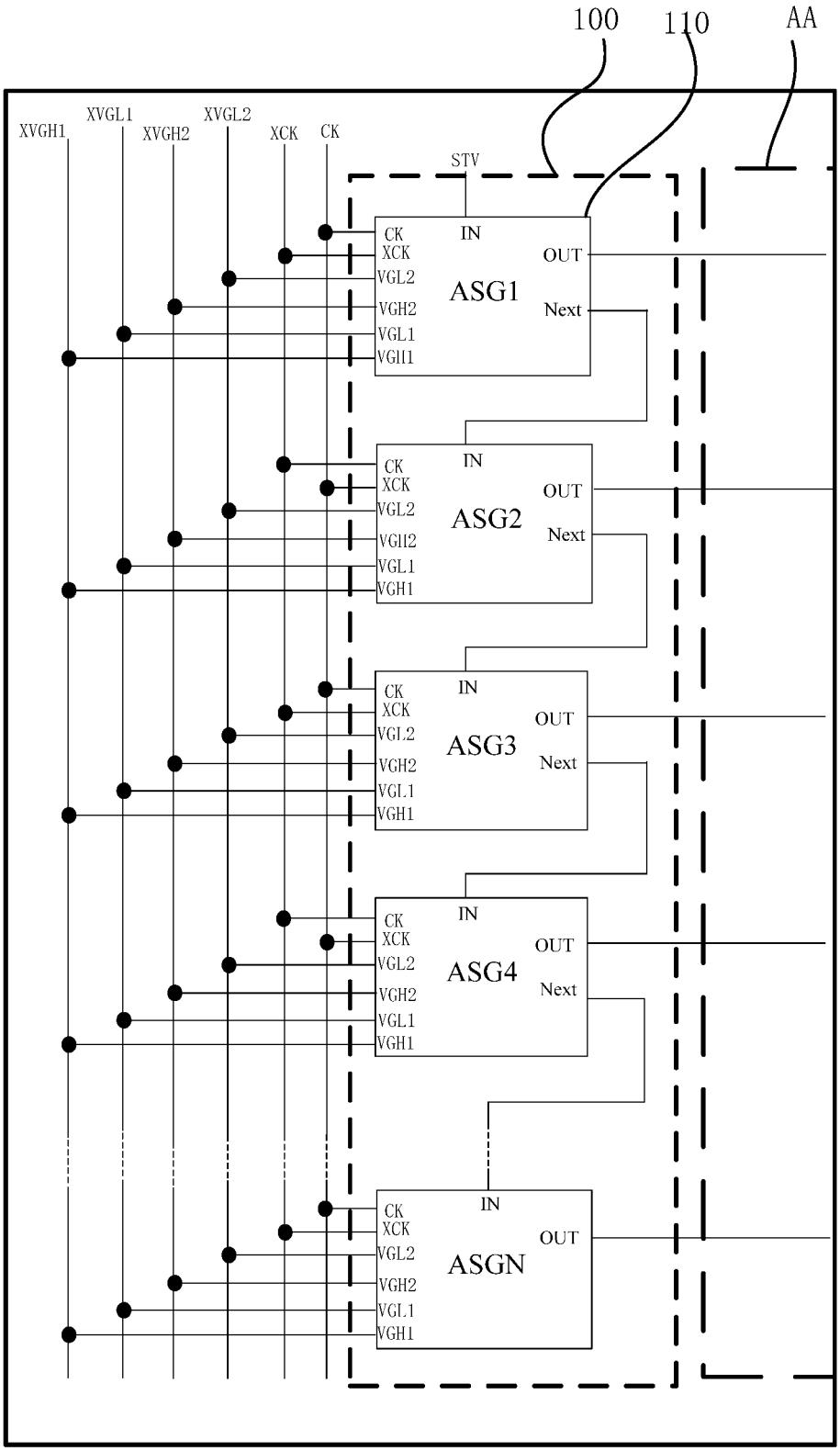
FIG. 2 illustrates a schematic diagram of a driving circuit of an exemplary display panel consistent with disclosed embodiments of the present disclosure.
Figure 3:
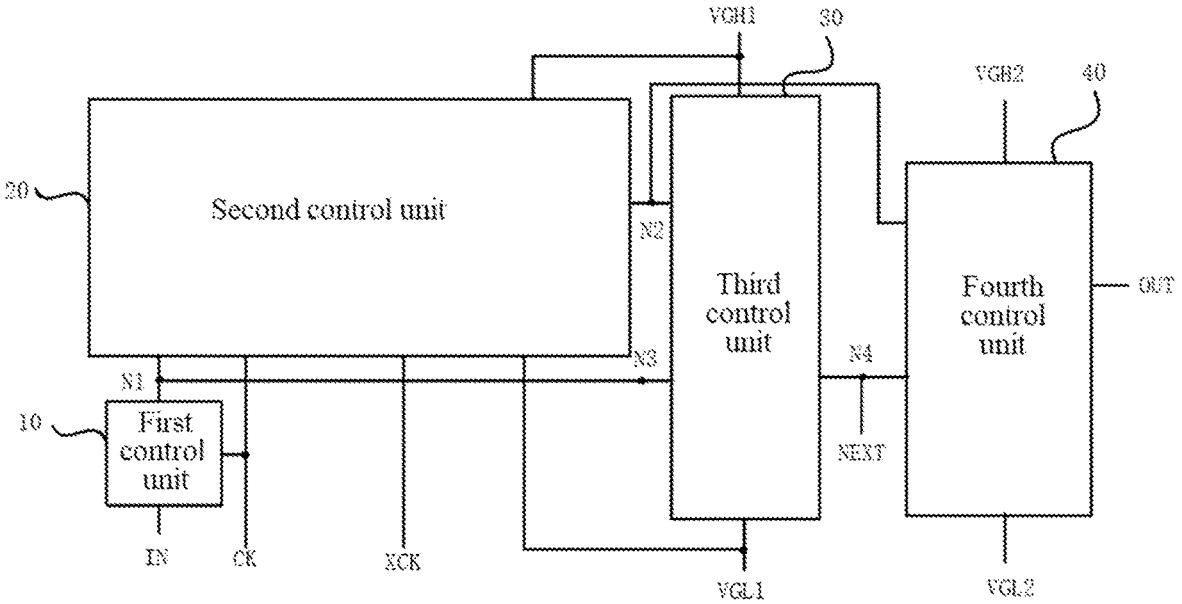
FIG. 3 illustrates a schematic diagram of a frame structure of a shift register of an exemplary display panel consistent with disclosed embodiments of the present disclosure.

FIG. 2 illustrates a schematic diagram of a driving circuit of a display panel consistent with disclosed embodiments of the present disclosure; and FIG. 3 illustrates a schematic diagram of a frame structure of a shift register of a display panel consistent with disclosed embodiments of the present disclosure. Referring to FIG. 2 and FIG. 3, in one embodiment, the driving circuit 100 in the display panel may include N-level shift registers 110 cascaded with each other, where $N \geq 2$.

A shift register 110 in the driving circuit 100 may include a first control unit 10, a second control unit 20, a third control unit 30, and a fourth control unit 40.

The first control unit 10 may be configured to receive the input signal IN, and control a signal of a first node N1 in response to a first clock signal CK. The second control unit 20 may be configured to receive a first voltage signal VGH1 and a second voltage signal VGL1, and control a signal of a second node N2 in response to the signal of the first node N1, the first clock signal CK, and a second clock signal XCK. The third control unit 30 may be configured to receive the first voltage signal VGH1 and the second voltage signal VGL1, and control a signal of the fourth node N4 in response to the signal of the second node N2 and a signal of a third node N3, where the third node N3 may be connected to the first node N1, the first voltage signal VGH1 may be a high-level signal, and the second voltage signal VGL1 may be a low-level signal.

The fourth control unit 40 may be configured to receive a third voltage signal VGH2 and a fourth voltage signal VGL2, and generate an output signal OUT in response to the signal of the second node N2 and the signal of the fourth node N4, where the third voltage signal VGH2 may be a high-level signal, the fourth voltage signal VGL2 may be a low-level signal, a potential of the first voltage signal VGH1 may be greater than a potential of the third voltage signal VGH2, and/or a potential of the second voltage signal VGL1 may be less than a potential of the fourth voltage signal VGL2.

Specifically, in one embodiment, based on the input signal IN, the first clock signal CK, the second clock signal XCK, the first voltage signal VGH1 and the second voltage signal VGL1, the signal of the second node N2 and the signal of the fourth node N4 may be controlled through the first control unit 10, the second control unit 20, and the third control unit 30. The fourth control unit 40 may be configured to receive the third voltage signal VGH2 and the fourth voltage signal VGL2, and in response to the signal of the second node N2 and the signal of the fourth node N4 controlled by the first control unit 10, the second control unit 20 and the third control unit 30, generate the output signal OUT. In other words, the first control unit 10, the second control unit 20, and the third control unit 30 may be a control part of the shift register 110. The fourth control unit 40 may be an output part of the shift register 110 and may be configured to generate the output signal.

The voltage signals (the third voltage signal VGH2 and the fourth voltage signal VGL2) received by the fourth control unit 40 and the voltage signals (the first voltage signal VGH1 and the second voltage signal VGL1) received by the first control unit 10, the second control unit 20, and the third control unit 30 may be set respectively. In other words, the voltage signals of the control part and the voltage signals of the output part of the shift register 110 may be set respectively, such that the voltage signals received by the fourth control unit 40 may be set directed to the requirements of the pixel circuit in the display panel for different signals, and the required signal may be selectively outputted, which may improve the flexibility of the signals outputted by the driving circuit 100.

Moreover, because the potential of the first voltage signal VGH1 is greater than the potential of the third voltage signal VGH2, and/or the potential of the second voltage signal VGL1 is less than the potential of the fourth voltage signal VGL2, the waveform stability of the output signal OUT generated by the fourth control unit 40 may increase, which may improve the stability of the signal outputted by the driving circuit 100.

Figure 4:
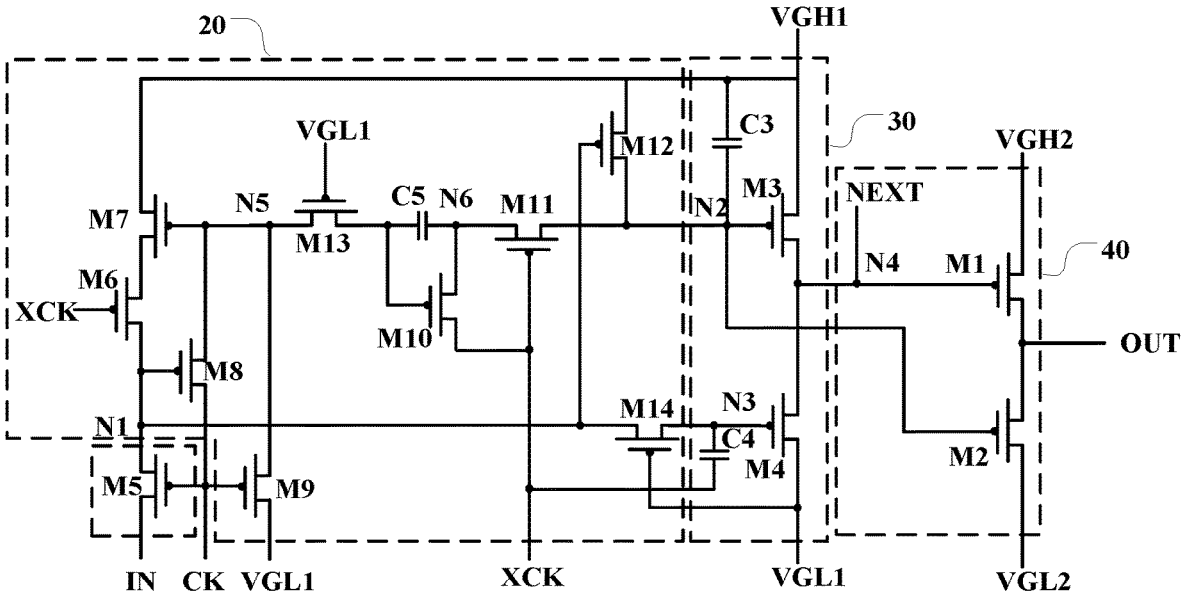
FIG. 4 illustrates a schematic circuit diagram of a shift register of an exemplary display panel consistent with disclosed embodiments of the present disclosure.

FIG. 4 illustrates a schematic circuit diagram of a shift register of a display panel consistent with disclosed embodiments of the present disclosure. Referring to FIG. 4, in one embodiment, the fourth control unit 40 may include a first transistor M1 and a second transistor M2. The first transistor M1 may receive the third voltage signal VGH2, and the second transistor M2 may receive the fourth voltage signal VGL2, to generate the output signal OUT.

Specifically, the fourth control unit 40 may include the first transistor M1 and the second transistor M2. The first transistor M1 may receive the third voltage signal VGH2, and the second transistor M2 may receive the fourth voltage signal VGL2, to generate the output signal OUT. The output signal OUT may be controlled by the first transistor M1 and the second transistor M2, respectively. When the first transistor M1 is turned on, the output signal OUT may be the third voltage signal VGH2, and when the second transistor M2 is turned on, the output signal OUT may be the fourth voltage Signal VGL2.

Referring to FIG. 4, in one embodiment, both the first transistor M1 and the second transistor M2 may be PMOS transistors. A source of the first transistor M1 may be connected to the third voltage signal VGH2, a drain of the first transistor M1 may be connected to the output signal OUT, and a gate of the first transistor M1 may be connected to the fourth node N4. A source of the second transistor M2 may be connected to the fourth voltage signal VGL2, a drain of the second transistor M2 may be connected to the output signal OUT, and a gate of the second transistor M2 may be connected to the second node N2.

Specifically, when the fourth node N4 is at a low level, the first transistor M1 may be turned on, and the third voltage signal VGH2 may be transmitted to the drain of the first transistor M1, to generate the output signal OUT. When the fourth node N4 is at a high level, the first transistor M1 may be turned off. When the second node N2 is at a low level, the second transistor M2 may be turned on, and the fourth voltage signal VGL2 may be transmitted to the drain of the second transistor M2, to generate the output signal OUT. When the second node N2 is at a high level, the second transistor M2 may be turned off. In other words, the high level of the output signal OUT may be determined by the fourth node N4, and the low level of the output signal OUT may be determined by the second node N2.

Figure 5:
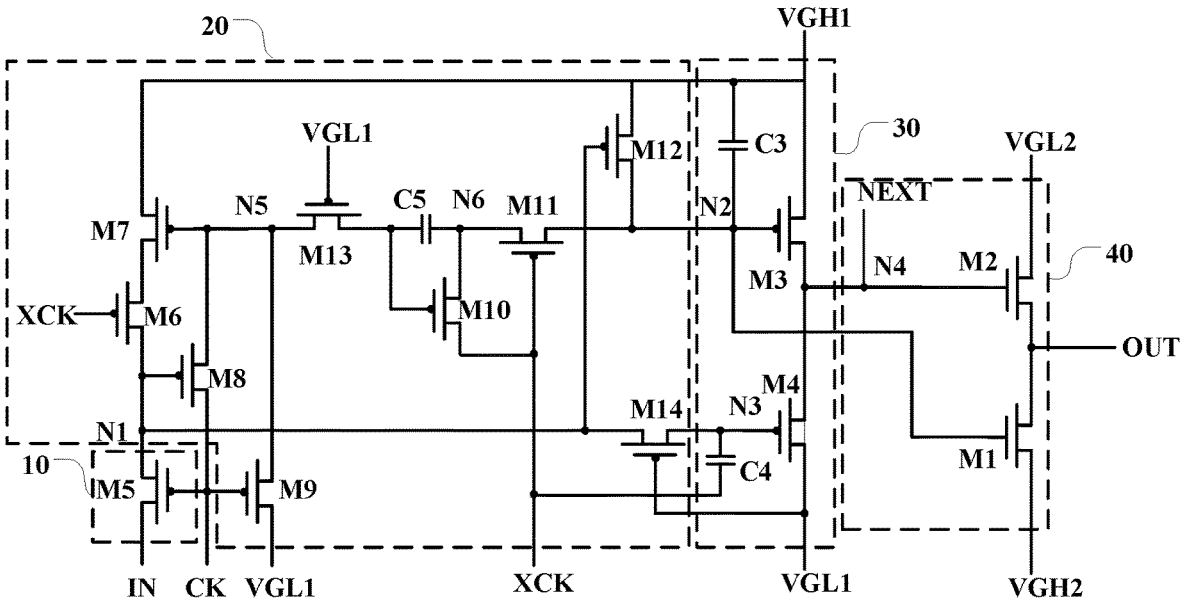
FIG. 5 illustrates a schematic circuit diagram of a shift register of another exemplary display panel consistent with disclosed embodiments of the present disclosure.

FIG. 5 illustrates a schematic circuit diagram of a shift register of a display panel consistent with disclosed embodiments of the present disclosure. Referring to FIG. 5, in one embodiment, both the first transistor M1 and the second transistor M2 may be NMOS transistors.

The source of the first transistor M1 may be connected to the third voltage signal VGH2, the drain of the first transistor M1 may be connected to the output signal OUT, and the gate of the first transistor M1 may be connected to the second node N2. The source of the second transistor M2 may be connected to the fourth voltage signal VGL2, the drain of the second transistor M2 may be connected to the output signal OUT, and the gate of the second transistor M2 may be connected to the fourth node N4.

Specifically, when the second node N2 is at a low level, the first transistor M1 may be turned off. When the second node N2 is at a high level, the first transistor M1 may be turned on, and the third voltage signal VGH2 may be transmitted to the drain of the first transistor M1, to generate the output signal OUT. When the fourth node N4 is at a low level, the second transistor M2 may be turned off. When the fourth node N4 is at a high level, the second transistor M2 may be turned on, and the fourth voltage signal VGL2 may be transmitted to the drain of the second transistor M2, to generate the output signal OUT. In other words, the high level of the output signal OUT may be determined by the second node N2, and the low level of the output signal OUT may be determined by the fourth node N4.

Figure 6:
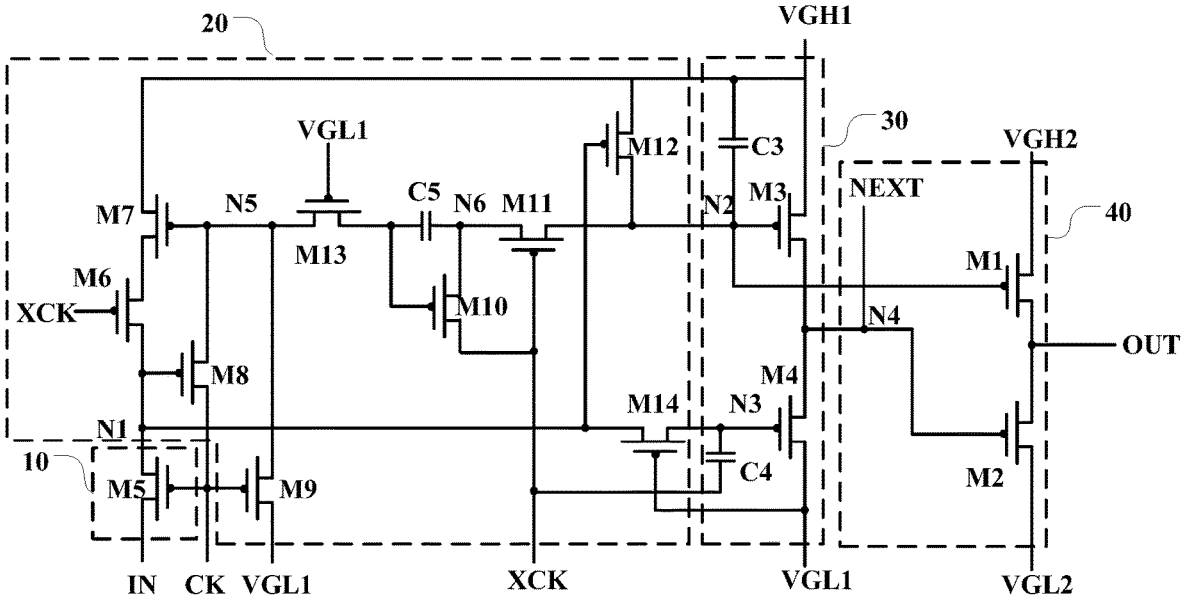
FIG. 6 illustrates a schematic circuit diagram of a shift register of another exemplary display panel consistent with disclosed embodiments of the present disclosure.

FIG. 6 illustrates a schematic circuit diagram of a shift register of a display panel consistent with disclosed embodiments of the present disclosure. Referring to FIG. 6, in one embodiment, both the first transistor M1 and the second transistor M2 may be PMOS transistors.

The source of the first transistor M1 may be connected to the third voltage signal VGH2, the drain of the first transistor M1 may be connected to the output signal OUT, and the gate of the first transistor M1 may be connected to the second node N2. The source of the second transistor M2 may be connected to the fourth voltage signal VGL2, the drain of the second transistor M2 may be connected to the output signal OUT, and the gate of the second transistor M2 may be connected to the fourth node N4.

Specifically, when the second node N2 is at a low level, the first transistor M1 may be turned on, and the third voltage signal VGH2 may be transmitted to the drain of the first transistor M1, to generate the output signal OUT. When the second node N2 is at a high level, the first transistor M1 may be turned off. When the fourth node N4 is at a low level, the second transistor M2 may be turned on, and the fourth voltage signal VGL2 may be transmitted to the drain of the second transistor M2, to generate the output signal OUT. When the fourth node N4 is at a high level, the second transistor M2 may be turned off. In other words, the high level of the output signal OUT may be determined by the second node N2, and the low level of the output signal OUT may be determined by the fourth node N4.

Figure 7:
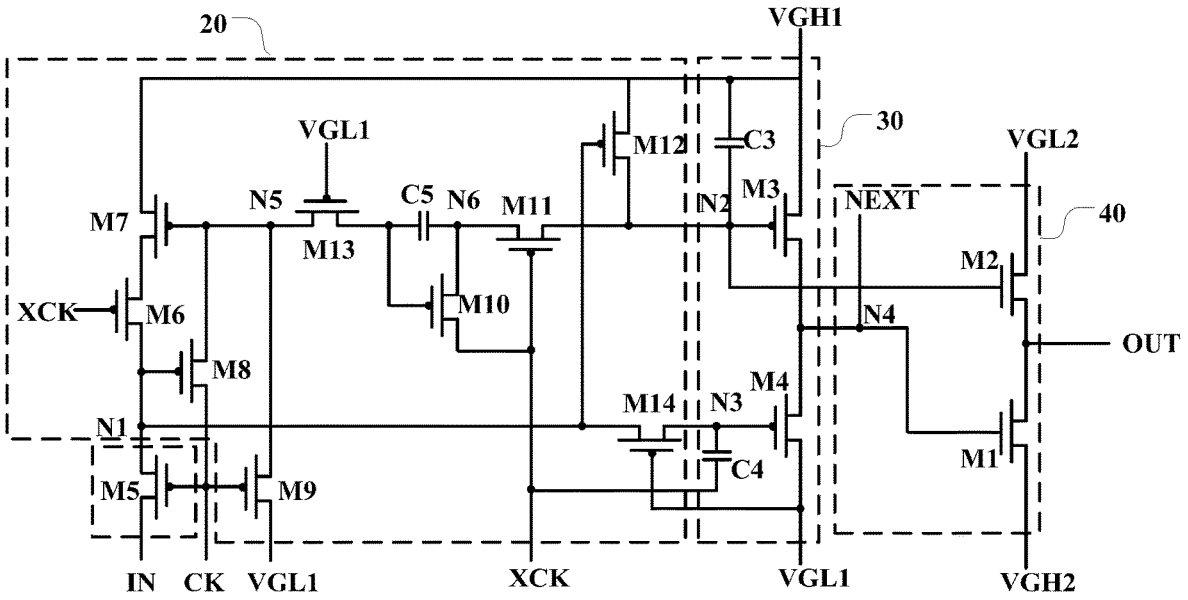
FIG. 7 illustrates a schematic circuit diagram of a shift register of another exemplary display panel consistent with disclosed embodiments of the present disclosure.

FIG. 7 illustrates a schematic circuit diagram of a shift register of a display panel consistent with disclosed embodiments of the present disclosure. Referring to FIG. 7, in one embodiment, both the first transistor M1 and the second transistor M2 may be NMOS transistors.

The source of the first transistor M1 may be connected to the third voltage signal VGH2, the drain of the first transistor M1 may be connected to the output signal OUT, and the gate of the first transistor M1 may be connected to the fourth node N4. The source of the second transistor M2 may be connected to the fourth voltage signal VGL2, the drain of the second transistor M2 may be connected to the output signal OUT, and the gate of the second transistor M2 may be connected to the second node N2.

Specifically, when the fourth node N4 is at a low level, the first transistor M1 may be turned off. When the fourth node N4 is at a high level, the first transistor M1 may be turned on, and the third voltage signal VGH2 may be transmitted to the drain of the first transistor M1, to generate the output signal OUT. When the second node N2 is at a low level, the second transistor M2 may be turned off. When the second node N2 is at a high level, the second transistor M2 may be turned on, and the fourth voltage signal VGL2 may be transmitted to the drain of the second transistor M2, to generate the output signal OUT. In other words, the high level of the output signal OUT may be determined by the fourth node N4, and the low level of the output signal OUT may be determined by the second node N2.

On the basis of any of the foregoing embodiments, in certain embodiments, to ensure the stability of the potentials of the second node N2 and the fourth node N4 and ensure the stability of the output signal OUT, in one embodiment, the fourth control unit 40 may further include a first capacitor C1 and a second capacitor C2.

Figure 8:
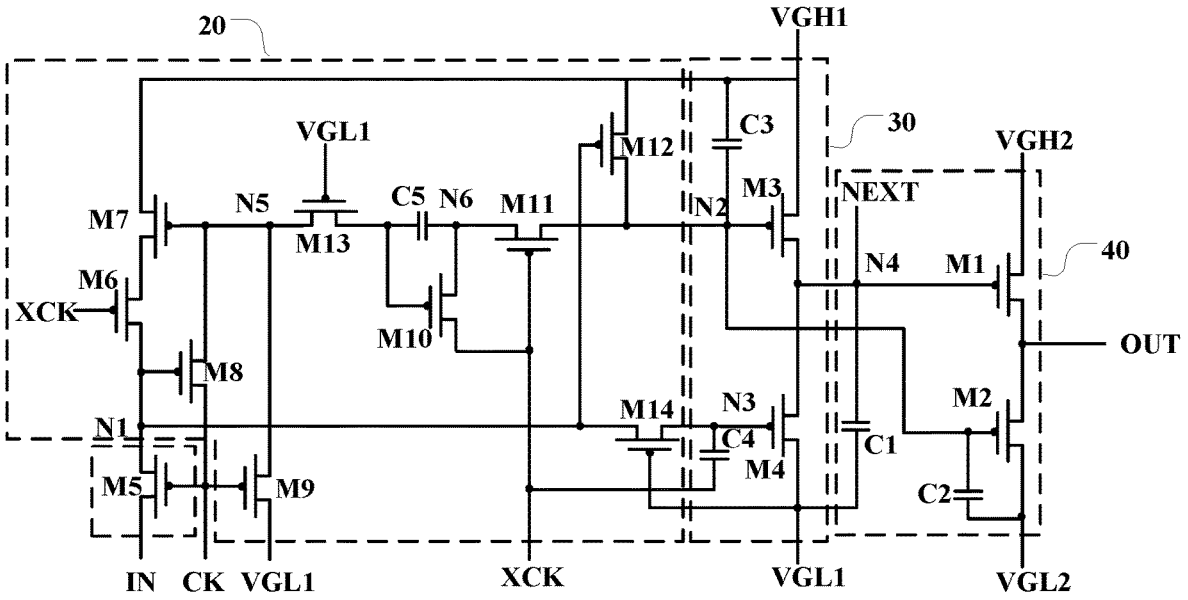
FIG. 8 illustrates a schematic circuit diagram of a shift register of another exemplary display panel consistent with disclosed embodiments of the present disclosure.

FIG. 8 illustrates a schematic circuit diagram of a shift register of a display panel consistent with disclosed embodiments of the present disclosure. Referring to FIG. 8, a first plate of the first capacitor C1 may be connected to the second voltage signal VGL1, and a second plate of the first capacitor C1 may be connected to the fourth node N4. A first plate of the second capacitor C2 may be connected to the second node N2, and a second plate of the second capacitor C2 may be connected to the fourth voltage signal VGL2.

Figure 9:
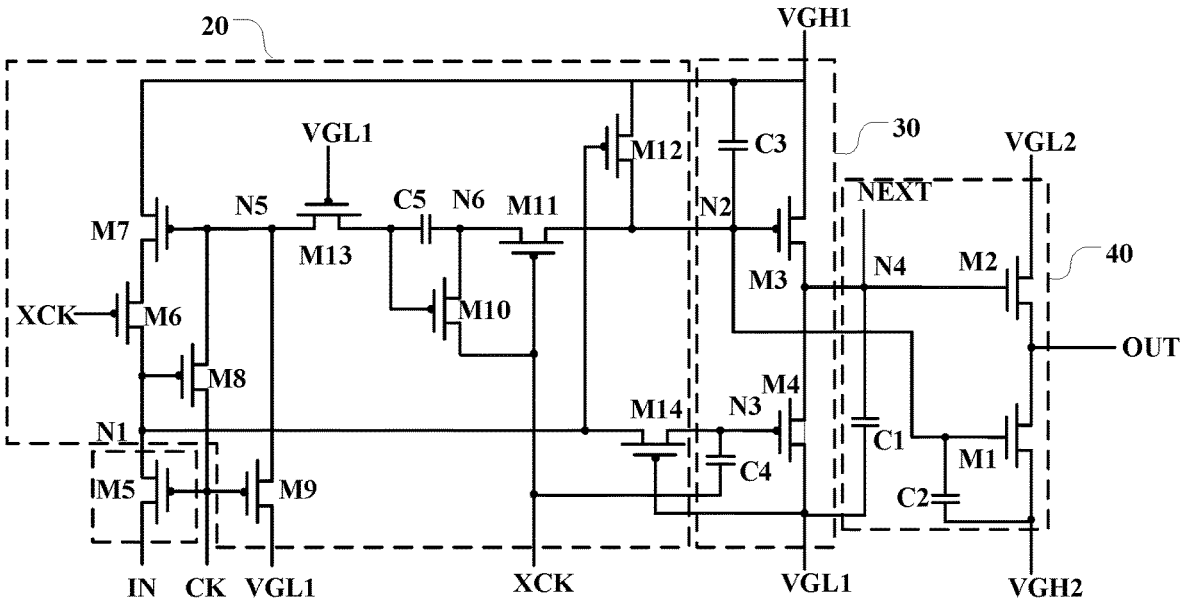
FIG. 9 illustrates a schematic circuit diagram of a shift register of another exemplary display panel consistent with disclosed embodiments of the present disclosure.

FIG. 9 illustrates a schematic circuit diagram of a shift register of a display panel consistent with disclosed embodiments of the present disclosure. Referring to FIG. 9, the first plate of the first capacitor C1 may be connected to the second voltage signal VGL1, and the second plate of the first capacitor C1 may be connected to the fourth node N4. The first plate of the second capacitor C2 may be connected to the second node N2, and the second plate of the second capacitor C2 may be connected to the third voltage signal VGH2.

Figure 10:
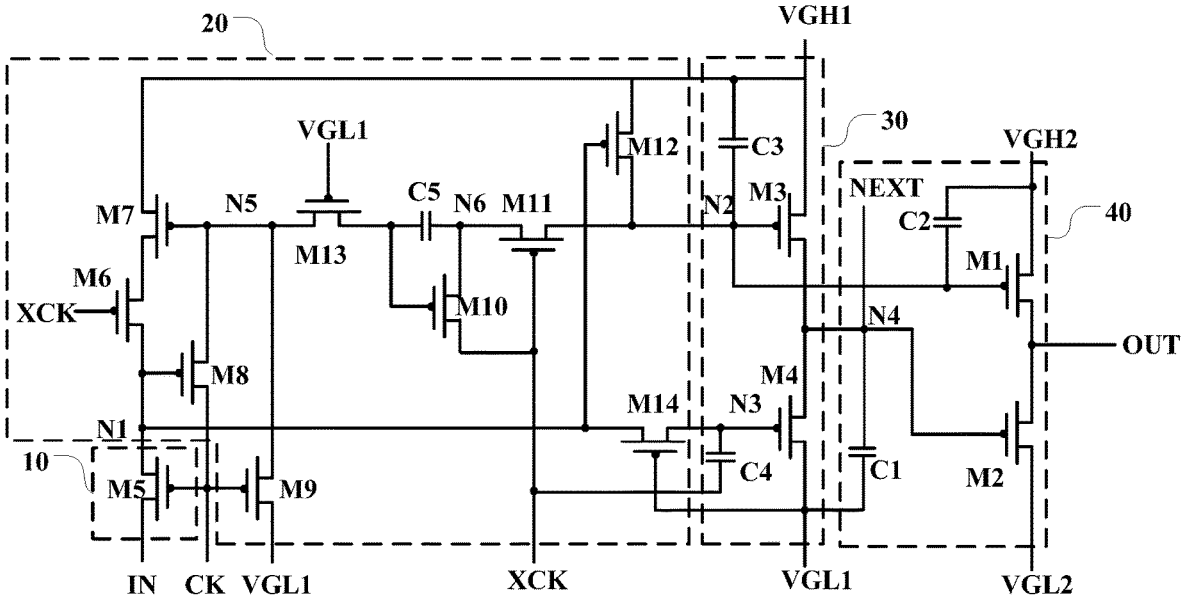
FIG. 10 illustrates a schematic circuit diagram of a shift register of another exemplary display panel consistent with disclosed embodiments of the present disclosure.

FIG. 10 illustrates a schematic circuit diagram of a shift register of a display panel consistent with disclosed embodiments of the present disclosure. Referring to FIG. 9 and FIG. 10, the first plate of the first capacitor C1 may be connected to the second voltage signal VGL1, and the second plate of the first capacitor C1 may be connected to the fourth node N4. The first plate of the second capacitor C2 may be connected to the second node N2, and the second plate of the second capacitor C2 may be connected to the third voltage signal VGH2.

Figure 11:
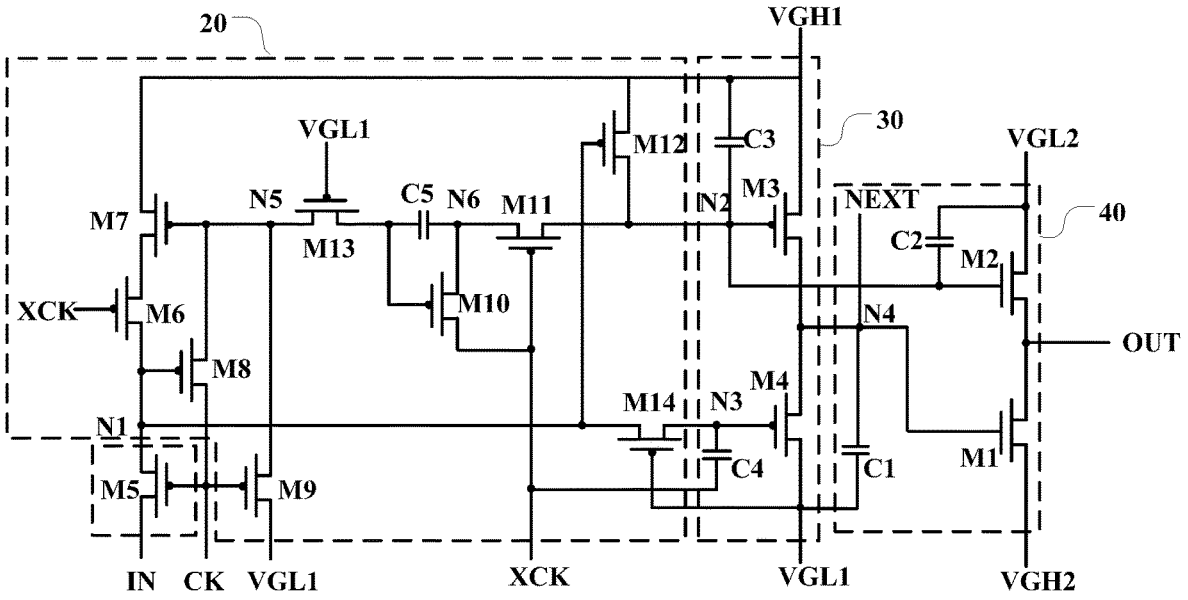
FIG. 11 illustrates a schematic circuit diagram of a shift register of another exemplary display panel consistent with disclosed embodiments of the present disclosure.

FIG. 11 illustrates a schematic circuit diagram of a shift register of a display panel consistent with disclosed embodiments of the present disclosure. Referring to FIG. 11, the first plate of the first capacitor C1 may be connected to the second voltage signal VGL1, and the second plate of the first capacitor C1 may be connected to the fourth node N4. The first plate of the second capacitor C2 may be connected to the second node N2, and the second plate of the second capacitor C2 may be connected to the fourth voltage signal VGL2.

In certain embodiments, the second plate of the first capacitor C1 may be connected to the fourth node N4, and the connection mode of the first plate of the first capacitor C1 may be adjusted. The first plate of the first capacitor C1 may be connected to one of the first voltage signal VGH1, the second voltage signal VGL1, the third voltage signal VGH2, the fourth voltage signal VGL2, and the output signal OUT. The potential of the fourth node N4 may be stabilized by a fixed potential or the output signal.

The first plate of the second capacitor C2 may be connected to the second node N2, and the connection mode of the second plate of the second capacitor C2 may be adjusted. The second plate of the second capacitor C2 may be connected to one of the first voltage signal VGH1, the second voltage signal VGL1, the third voltage signal VGH2, the fourth voltage signal VGL2, and the output signal OUT. The potential of the second node N2 may be stabilized by a fixed potential or the output signal.

Based on any of the foregoing embodiments, referring to FIGS. 8-11, in one embodiment, the first control unit 10 may include a fifth transistor M5. A source of the fifth transistor M5 may be connected to the input signal IN, a drain of the fifth transistor M5 may be connected to the first node N1, and the gate of the fifth transistor M5 may be connected to the first clock signal CK.

The second control unit 20 may include a sixth transistor M6, a seventh transistor M7, an eighth transistor M8, a ninth transistor M9, a tenth transistor M10, an eleventh transistor M11, a twelfth transistor M12, and a fifth capacitor C5. A source of the sixth transistor M6 may be connected to the first node N1, a drain of the sixth transistor M6 may be connected to a drain of the seventh transistor M7, and a gate of the sixth transistor M6 may be connected to the second clock signal XCK. A source of the seventh transistor M7 may be connected to the first voltage signal VGH1, the drain of the seventh transistor M7 may be connected to the drain of the sixth transistor M6, and a gate of the seventh transistor M7 may be connected to a fifth node N5. A source of the eighth transistor M8 may be connected to the first clock signal CK, a drain of the eighth transistor M8 may be connected to the fifth node N5, and a gate of the eighth transistor M8 may be connected to the first node N1. A source of the ninth transistor M9 may be connected to the second clock signal XCK, a drain of the ninth transistor M9 may be connected to the fifth node N5, and a gate of the ninth transistor M9 may be connected to the first clock signal CK. A source of the tenth transistor M10 may be connected to the second clock signal XCK, a drain of the tenth transistor M10 may be connected to a sixth node N6, and a gate of the tenth transistor M10 may be connected to the fifth node N5. A source of the eleventh transistor M11 may be connected to the sixth node N6, a drain of the eleventh transistor M11 may be connected to the second node N2, and a gate of the eleventh transistor M11 may be connected to the second clock signal XCK. A source of the twelfth transistor M12 may be connected to the first voltage signal VGH1, a drain of the twelfth transistor M12 may be connected to the second node N2, and a gate of the twelfth transistor M12 may be connected to the third node N3. A first plate of the fifth capacitor C5 may be connected to the fifth node N5, and a second plate of the fifth capacitor C5 may be connected to the sixth node N6.

Based on any of the foregoing embodiments, referring to FIGS. 8-11, in one embodiment, the second control unit 20 may further include a thirteenth transistor M13 and a fourteenth transistor M14.

A source of the thirteenth transistor M13 may be connected to the fifth node N5, a drain of the thirteenth transistor M13 may be connected to the gate of the tenth transistor M10, and a gate of the thirteenth transistor M13 may be connected to the second voltage signal VGL1. A source of the fourteenth transistor M14 may be connected to the first node N1, a drain of the fourteenth transistor M14 may be connected to the third node N3, and a gate of the fourteenth transistor M14 may be connected to the second voltage signal VGL1.

Based on any of the foregoing embodiments, referring to FIGS. 8-11, in one embodiment, the third control unit 30 may include a third transistor M3 and a fourth transistor M4.

A source of the third transistor M3 may be connected to the first voltage signal VGH1, a drain of the third transistor M3 may be connected to the fourth node N4, and a gate of the third transistor M3 may be connected to the second node N2. A source of the fourth transistor M4 may be connected to the second voltage signal VGL1, a drain of the fourth transistor M4 may be connected to the fourth node N4, and a gate of the fourth transistor M4 may be connected to the third node N3.

Because the first transistor M1 and the second transistor M2 are output transistors, to ensure the stability of the output signal OUT, the output performance requirements of the first transistor M1 and the second transistor M2 may be substantially high. Therefore, in certain embodiments, to improve the output performance of the first transistor M1 and the second transistor M2, a width-to-length ratio of a channel region of the first transistor M1 may be greater than a width-to-length ratio of a channel region of the third transistor M3, and/or a width-to-length ratio of a channel region of the second transistor M2 may be greater than a width-to-length ratio of a channel region of the fourth transistor M4.

Based on any of the foregoing embodiments, referring to FIGS. 8-11, in one embodiment, the third control unit 30 may further include a third capacitor C3 and a fourth capacitor C4.

A first plate of the third capacitor C3 may be connected to the first voltage signal VGH1, and a second plate of the third capacitor C3 may be connected to the second node N2. A first plate of the fourth capacitor C4 may be connected to the second clock signal XCK or the second voltage signal VGL1, and a second plate of the fourth capacitor C4 may be connected to the third node N3.

Because the first capacitor C1 and the second capacitor C2 are configured to stabilize the potentials of the second node N2 and the fourth node N4, and then stabilize the output signal OUT, the capacitance of the first capacitor C1 and the second capacitor C2 may need to be substantially large, to ensure that the potentials of the second node N2 and the fourth node N4 may not easily fluctuate.

Based on this, in certain embodiments, both a capacitance value of the first capacitor C1 and a capacitance value of the second capacitor C2 may be greater than a capacitance value of the third capacitor C3 and greater than a capacitance value of the fourth capacitor C4, which may not be limited by the present disclosure. In certain embodiments, to simplify the manufacturing process, the capacitance value of the first capacitor C1, the capacitance value of the second capacitor C2, the capacitance value of the third capacitor C3 and the capacitance value of the fourth capacitor C4 may be equal.

Optionally, in certain embodiments, to ensure the stability of the potentials of the second node N2 and the fourth node N4, a capacitance value of the fifth capacitor C5 may be less than the capacitance value of the first capacitor C1, and less than the capacitance value of the second capacitor C2. Because the stability of the potentials of the second node N2 and the fourth node N4 affects the stability of the output signal OUT, while the stability of the fifth node N5 has little effect on the stability of the output signal OUT, the fifth capacitor C5 may be set substantially small to save space.

Optionally, in certain embodiments, the capacitance value of the fifth capacitor C5 may be less than the capacitance value of the third capacitor C3, and may be less than the capacitance value of the fourth capacitor C4. The fifth capacitor C5 may be set further substantially small to save space.

The working process of the shift register may be described below in conjunction with the timing diagram of each signal in the shift register.

Figure 12:
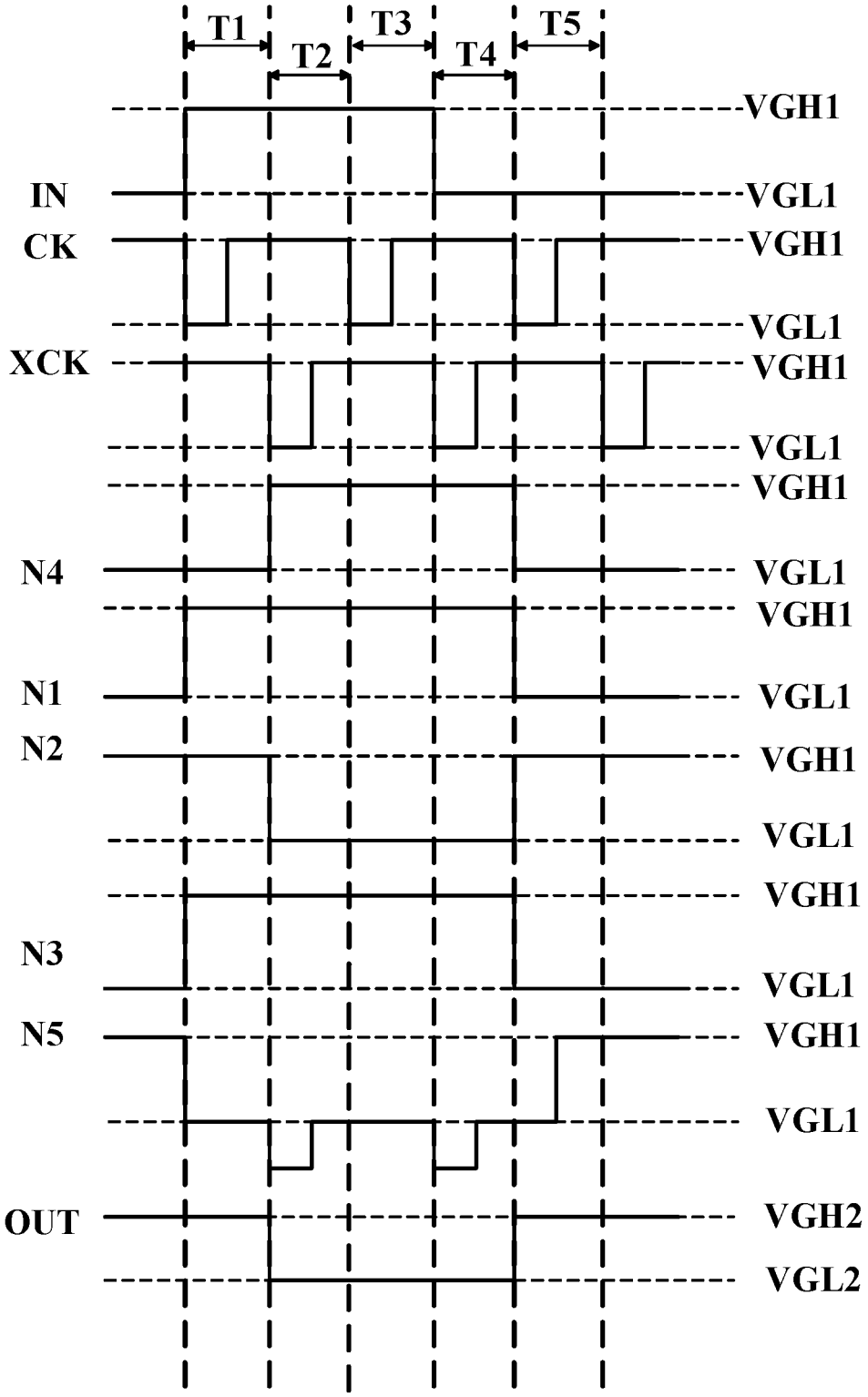
FIG. 12 illustrates a driving timing diagram of a shift register of an exemplary display panel consistent with disclosed embodiments of the present disclosure.

FIG. 12 illustrates a driving timing diagram of a shift register of a display panel consistent with disclosed embodiments of the present disclosure. Referring to FIG. 8 and FIG. 12, in a stage T1: the input signal IN may be at a high level, the first clock signal CK may be at a low level, the fifth transistor M5 may be turned on, and the input signal IN may be transmitted to the first node N1, such that the first node N1 may be at a high level. The ninth transistor M9 may be turned on, the second voltage signal VGL1 may be transmitted to the fifth node N5, such that the fifth node N5 may be at a low level. The tenth transistor M10 may be turned on, the second clock signal XCK may be at a high level, the sixth node N6 may be maintained at a high level, the sixth transistor M6 may be turned off, the eleventh transistor M11 may be turned off, the twelfth transistor M12 may be turned off, the second node N2 may be maintained at a high level, the second transistor M2 may be turned off, the third transistor M3 may be turned off, the third node N3 may be maintained at a high level, the fourth transistor M4 may be turned off, the fourth node N4 may be maintained at a low level, the first transistor M1 may be turned on, and the third voltage signal VGH2 may be transmitted to the output terminal to make the output signal OUT at a high level.

In a stage T2: the input signal IN may be at a high level, the first clock signal CK may be at a high level, the fifth transistor M5 may be turned off, the ninth transistor M9 may be turned off, the first node N1 may be maintained at a high level, the second clock signal XCK may be at a low level, the sixth transistor M6 may be turned on, the eighth transistor M8 may be turned off, the fifth node N5 may be maintained at a low level, the tenth transistor M10 may be turned on, and the second clock signal XCK may be transmitted to the sixth node N6, such that the sixth node N6 may be at a low level. The eleventh transistor M11 may be turned on, the signal of the sixth node N6 may be transmitted to the second node N2, such that the second node N2 may be at a low level. The third transistor M3 may be turned on, and the first voltage signal VGH1 may be transmitted to the fourth node N4, such that the fourth node N4 may be at a high level. The first transistor M1 may be turned off, the second transistor M2 may be turned on, and the fourth voltage signal VGL2 may be transmitted to the output terminal to make the output signal OUT at a low level.

In a stage T3: the input signal IN may be at a high level, the first clock signal CK may be at a low level, the fifth transistor M5 may be turned on, and the input signal IN may be transmitted to the first node N1, such that the first node N1 may be at a high level. The ninth transistor M9 may be turned on, and the second voltage signal VGL1 may be transmitted to the fifth node N5, such that the fifth node N5 may be at a low level. The tenth transistor M10 may be turned on, the second clock signal XCK may be at a high level, the sixth node N6 may be maintained at a high level, the sixth transistor M6 may be turned off, the eleventh transistor M11 may be turned off, the twelfth transistor M12 may be turned off, the third transistor M3 may be turned off, the third node N3 may be maintained at a high level, the fourth transistor M4 may be turned off, the fourth node N4 may be maintained at a high level, the first transistor M1 may be turned off, the second node N2 may be maintained at a low level, the second transistor M2 may be turned on, and the fourth voltage signal VGL2 may be transmitted to the output terminal, to make the output signal OUT at a low level.

In a stage T4: the input signal IN may be at a low level, the first clock signal CK may be at a high level, the fifth transistor M5 may be turned off, the ninth transistor M9 may be turned off, the first node N1 may be maintained at a high level, the second clock signal XCK may be at a low level, the sixth transistor M6 may be turned on, the eighth transistor M8 may be turned off, the fifth node N5 may be maintained at a low level, the tenth transistor M10 may be turned on, and the second clock signal XCK may be transmitted to the sixth node N6, such that the sixth node N6 may be maintained at a low level. The eleventh transistor M11 may be turned on, and the signal of the sixth node N6 may be transmitted to the second node N2, such that the second node N2 may be at a low level. The third transistor M3 may be turned on, and the first voltage signal VGH1 may be transmitted to the fourth node N4, such that the fourth node N4 may be at a high level. The first transistor M1 may be turned off, the second transistor M2 may be turned on, and the fourth voltage signal VGL2 may be transmitted to the output terminal, to make the output signal OUT at a low level.

In a stage T5: the input signal IN may be at a low level, the first clock signal CK may be at a low level, the fifth transistor M5 may be turned on, and the input signal IN may be transmitted to the first node N1, such that the first node N1 may be at a low level. The ninth transistor M9 may be turned on, the second voltage signal VGL1 may be transmitted to the fifth node N5, such that the fifth node N5 may be at a low level. The tenth transistor M10 may be turned on, the second clock signal XCK may be at a high level, the sixth node N6 may be maintained at a high level, the sixth transistor M6 may be turned off, the eleventh transistor M11 may be turned off, the first node N1 may control the twelfth transistor M12 to be turned on, and the first voltage signal VGH1 may be transmitted to the second node N2, such that the second node N2 may be at a high level. The third transistor M3 may be turned off, the second transistor M2 may be turned off, the fourteenth transistor M14 may be turned on, and the signal of the first node N1 may be transmitted to the third node N3, such that the third node N3 may be at a low level. The third node N3 may control the fourth transistor M4 to be turned on, and the second voltage signal VGL1 may be transmitted to the fourth node N4, such that the fourth node N4 may be at a low level. The first transistor M1 may be turned on, and the third voltage signal VGH2 may be transmitted to the output terminal, to make the output signal OUT at a high level.

In the shift register shown in FIG. 9, although the types of the first transistor M1 and the second transistor M2 are different from the types of the first transistor M1 and the second transistor M2 in the shift register shown in FIG. 8, in stages T1-T5, the levels of the first node N1, the second node N2, the third node N3, the fourth node N4, and the fifth node N5 may be the same as the above process associated with FIG. 8. The voltage signal inputted from the first transistor M1 in FIG. 9 may be different from the voltage signal inputted from the first transistor M1 in FIG. 8, and the voltage signal inputted from the second transistor M2 in FIG. 9 may also be different from the voltage signal inputted from the second transistor M2 in FIG. 8. Therefore, the level of the output signal OUT in FIG. 9 may be the same as the level of the output signal OUT in FIG. 8. In other words, the timing diagram of the signal of each node in the shift register shown in FIG. 9 may also refer to FIG. 12.

Figure 13:
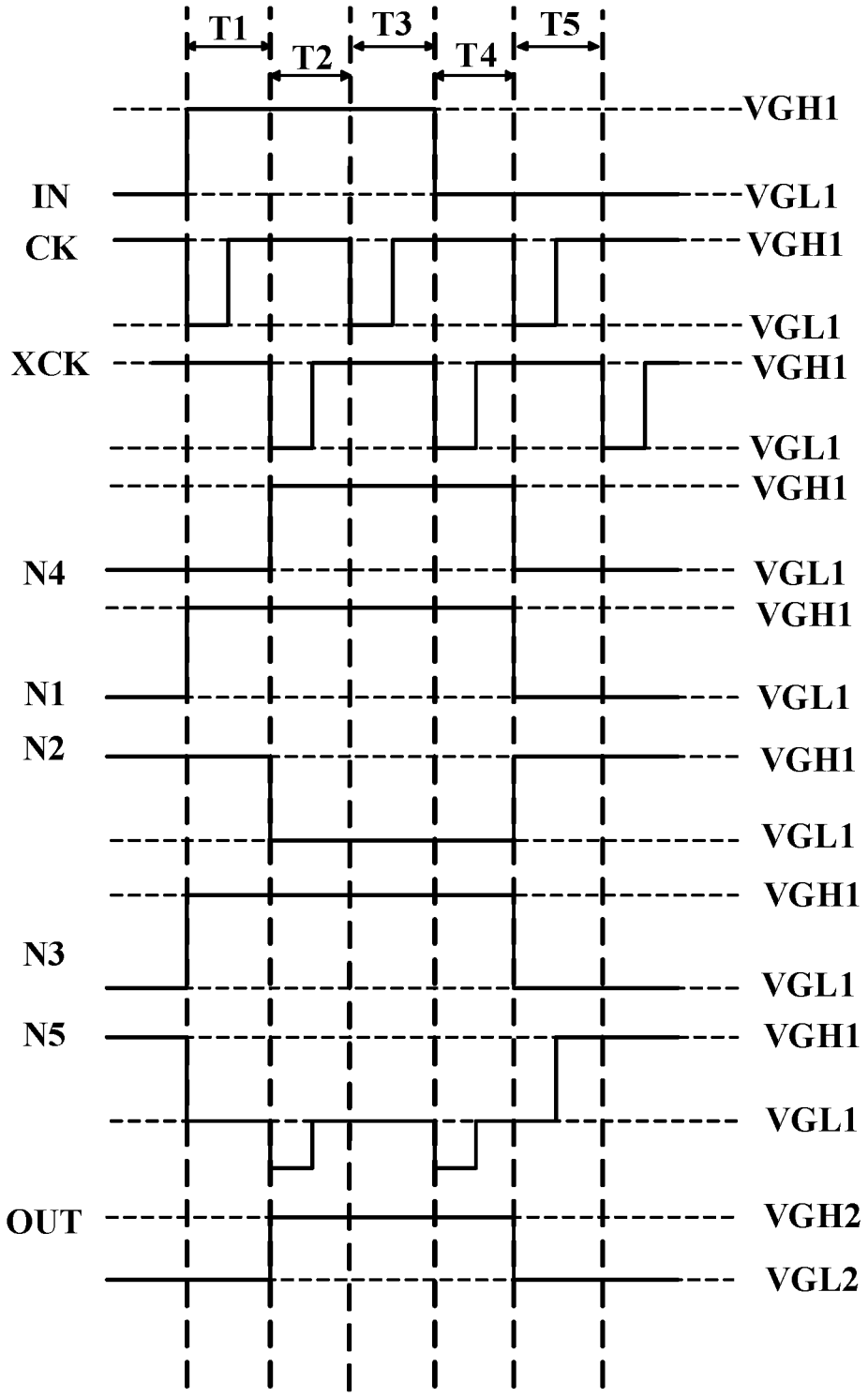
FIG. 13 illustrates a driving timing diagram of a shift register of another exemplary display panel consistent with disclosed embodiments of the present disclosure.

In the shift register shown in FIG. 10, merely the connection nodes of the first transistor M1 and the second transistor M2 may be different from the connection nodes shown in FIG. 8. Therefore, in stages T1-T5, the levels of the first node N1, the second node N2, the third node N3, the fourth node N4, and the fifth node N5 may be the same as the above process associated with FIG. 8, and the difference may include the level of the output signal OUT. Referring to FIG. 12, the level change state of the output signal OUT may be the same as the level change state of the second node N2. FIG. 13 illustrates a driving timing diagram of a shift register of another display panel consistent with disclosed embodiments of the present disclosure. Referring to FIG. 10 and FIG. 13, the level change state of the output signal OUT may be the same as the level change state of the fourth node N4.

In the shift register shown in FIG. 11, although the types of the first transistor M1 and the second transistor M2 are different from the types of the first transistor M1 and the second transistor M2 in the shift register shown in FIG. 10, in stages T1-T5, the levels of the first node N1, the second node N2, the third node N3, the fourth node N4, and the fifth node N5 may be the same as the above process associated with FIG. 10. The voltage signal inputted from the first transistor M1 in FIG. 11 may be different from the voltage signal inputted from the first transistor M1 in FIG. 10, and the voltage signal inputted from the second transistor M2 in FIG. 11 may also be different from the voltage signal inputted from the second transistor M2 in FIG. 10. Therefore, the level of the output signal OUT in FIG. 11 may be the same as the level of the output signal OUT in FIG. 10. In other words, the timing diagram of the signal of each node in the shift register shown in FIG. 11 may also refer to FIG. 13.

It should be noted that the first transistor M1 and the second transistor M2 may generate the output signal OUT under the control of the fourth node N4 and the second node N2, respectively. The high-level signal and the low-level signal of the second node N2 and the fourth node N4 may be the first voltage signal VGH1 and the second voltage signal VGL1, respectively. In other words, the control signals of the fourth control unit 40 may be the first voltage signal VGH1 and the second voltage signal VGL1, and the received signals of the fourth control unit 40 may be the third voltage signal VGH2 and the fourth voltage signal VGL2. Therefore, when the potential of the first voltage signal VGH1 is greater than the potential of the third voltage signal VGH2, and/or, the potential of the second voltage signal VGL1 is less than the fourth voltage signal VGL2, the control signal of the fourth control unit 40 may have an even higher level or an even lower level than the received signal of the fourth control unit 40.

The first transistor M1 and the second transistor M2 may be PMOS transistors. When receiving a low level and the level of the control signal is lower than the received low-level signal, the PMOS transistor may be ensured to operate in a substantially saturated state, thereby ensuring the stability of the output signal OUT and reducing the tailing phenomenon of the output signal. In addition, when the control signal is at a substantially high level, if the level received by the PMOS transistor is also at a high level, the PMOS transistor may be fully ensured to be turned off, and the risk of leakage current may be fully reduced. Therefore, in the disclosed embodiments, the stability of the output waveform may be fully improved, to avoid problems such as tailing and leakage current.

Similarly, the first transistor M1 and the second transistor M2 may be NMOS transistors. When receiving a high level and the level of the control signal is higher than the received high-level signal, the NMOS transistor may be ensured to operate in a substantially saturated state, thereby ensuring the stability of the output signal OUT and reducing the tailing phenomenon of the output signal. In addition, when the control signal is at a substantially low level, if the level received by the NMOS transistor is also at a low level, the NMOS transistor may be fully ensured to be turned off, and the risk of leakage current may be fully reduced. Therefore, in the disclosed embodiments, the stability of the output waveform may be fully improved, to avoid problems such as tailing and leakage current.

On the basis of the shift register shown in FIG. 8 and FIG. 10, in one embodiment, the width-to-length ratio of the channel region of the second transistor M2 may be greater than or equal to the width-to-length ratio of the channel region of the first transistor M1.

Specifically, because the second transistor M2 is a transistor connected to the fourth voltage signal VGL2, when the fourth voltage signal VGL2 is transmitted to the output terminal to make the output signal OUT at a low level, the potential of the second node N2 may be at a low level. For a PMOS transistor, when the source and gate are at a low level at the same time, to ensure the stability of the low-level signal outputted by the PMOS transistor, i.e., the output signal OUT, the output capability of the PMOS transistor may need to be improved as much as possible. The larger the width-to-length ratio of the channel region of the PMOS transistor, the stronger the output capability of the PMOS transistor. Therefore, the width-to-length ratio of the channel region of the PMOS transistor may need to be appropriately increased.

The third voltage signal VGH2 connected to the first transistor M1 may be a high-level signal. When the fourth node N4 is at a low level, the PMOS transistor may be operated in a substantially saturated state and may be fully turned on. Therefore, the first transistor M1 may need to have an output capability less than the second transistor M2, and, thus, the width-to-length ratio of the first transistor M1 may be set appropriately smaller.

Based on this, in certain embodiments, the width-to-length ratio of the channel region of the second transistor M2 may be set to be greater than the width-to-length ratio of the channel region of the first transistor M1. Similarly, to simplify the manufacturing process, the width-to-length ratio of the channel region of the second transistor M2 may be equal to the width-to-length ratio of the channel region of the first transistor M1.

On the basis of the shift registers shown in FIG. 9 and FIG. 11, in certain embodiments, the width-to-length ratio of the channel region of the second transistor M2 may be greater than or equal to the width-to-length ratio of the channel region of the first transistor M1.

Based on the shift register shown in FIG. 8, in one embodiment, the capacitance value of the first capacitor C1 may be less than or equal to the capacitance value of the second capacitor C2.

Because the second plate of the second capacitor C2 is connected to the fourth voltage signal VGL2, the first plate of the second capacitor C2 is connected to the second node N2, the source of the second transistor M2 is connected to the fourth voltage signal VGL2, and the gate is connected to the second node N2, when the second transistor M2 is a PMOS transistor and the second node N2 is a low-level signal, the output of the second transistor M2 may be unstable. By increasing the capacitance value of the second capacitor C2, the stability of the potential of the second node N2 may be improved. In view of this, the capacitance value of the first capacitor C1 may be set to be smaller than the capacitance value of the second capacitor C2. To simplify the manufacturing process, the capacitance value of the first capacitor C1 may be equal to the capacitance value of the second capacitor C2.

On the basis of the shift registers shown in FIGS. 9-11, in certain embodiments, the capacitance value of the first capacitor C1 may be less than or equal to the capacitance value of the second capacitor C2, which may not be repeated herein.

Referring to FIG. 1, FIG. 2 and FIG. 8, in one embodiment, the driving circuit may include N-level shift registers. In other words, the driving circuit may include N cascaded shift registers ASG1-ASGN. In the N-level shift registers of the driving circuit, a signal of the fourth node N4 of the $M^{th}$-level shift register may be connected to an input signal terminal of the $(M+1)^{th}$-level shift register as the input signal of the $(M+1)^{th}$-level shift register, where $1 \leq M \leq N$.

Specifically, in the driving circuit, the signal Next of the fourth node N4 of the previous-level shift register may be used as the input signal IN of the following-level shift register, and the output signal OUT of each shift register may be inputted to the pixel circuit as the driving signal, which may not be limited by the present disclosure. In certain embodiments, referring to FIG. 13, when the output signal OUT and the fourth node N4 have a same change state, the output signal OUT of the $M^{th}$-level shift register may be used as the input signal IN of the $(M+1)^{th}$-level shift register, and the signal Next of the fourth node N4 may be inputted to the pixel circuit as the driving signal.

Referring to FIG. 1 and FIG. 2, in one embodiment, the display panel may further include: a first voltage signal line XVGH1 providing the first voltage signal VGH1 for the driving circuit; a second voltage signal line XVGL1 providing the second voltage signal VGL1 for the driving circuit; a third voltage signal line XVGH2 providing the third voltage signal VGH2 for the driving circuit; and a fourth voltage signal line XVGL2 providing the fourth voltage signal VGL2 for the driving circuit.

Because the third voltage signal VGH2 and the fourth voltage signal VGL2 are configured to generate the output signal OUT, and the output signal OUT is configured to provide the driving signal for the pixel circuit 210 in the display region AA of the display panel, to save the space of the driving circuit 100 as much as possible, the signal line may be prevented excessively long, and the third voltage signal line XVGH2 and the fourth voltage signal line XVGL2 may be disposed on the side adjacent to the display region AA.

Based on this, in certain embodiments, at least one of the third voltage signal line XVGH2 and the fourth voltage signal line XVGL2 may be disposed on a side of at least one of the first voltage signal line XVGH1 and the second voltage signal line XVGL1 facing toward the display region of the display panel.

Referring to FIG. 2, in one embodiment, the first voltage signal line XVGH1, the second voltage signal line XVGL1, the third voltage signal line XVGH2, and the fourth voltage signal line XVGL2 may be disposed on a side of the driving circuit 100 facing away from the display region AA of the display panel. In addition, the third voltage signal line XVGH2 and the fourth voltage signal line XVGL2 may be disposed on the side of the first voltage signal line XVGH1 and the second voltage signal line XVGL1 adjacent to the display region AA, or facing toward the display region AA of the display panel, to save the space of the driving circuit 100 as much as possible and shorten the length of signal line.

Figure 14:
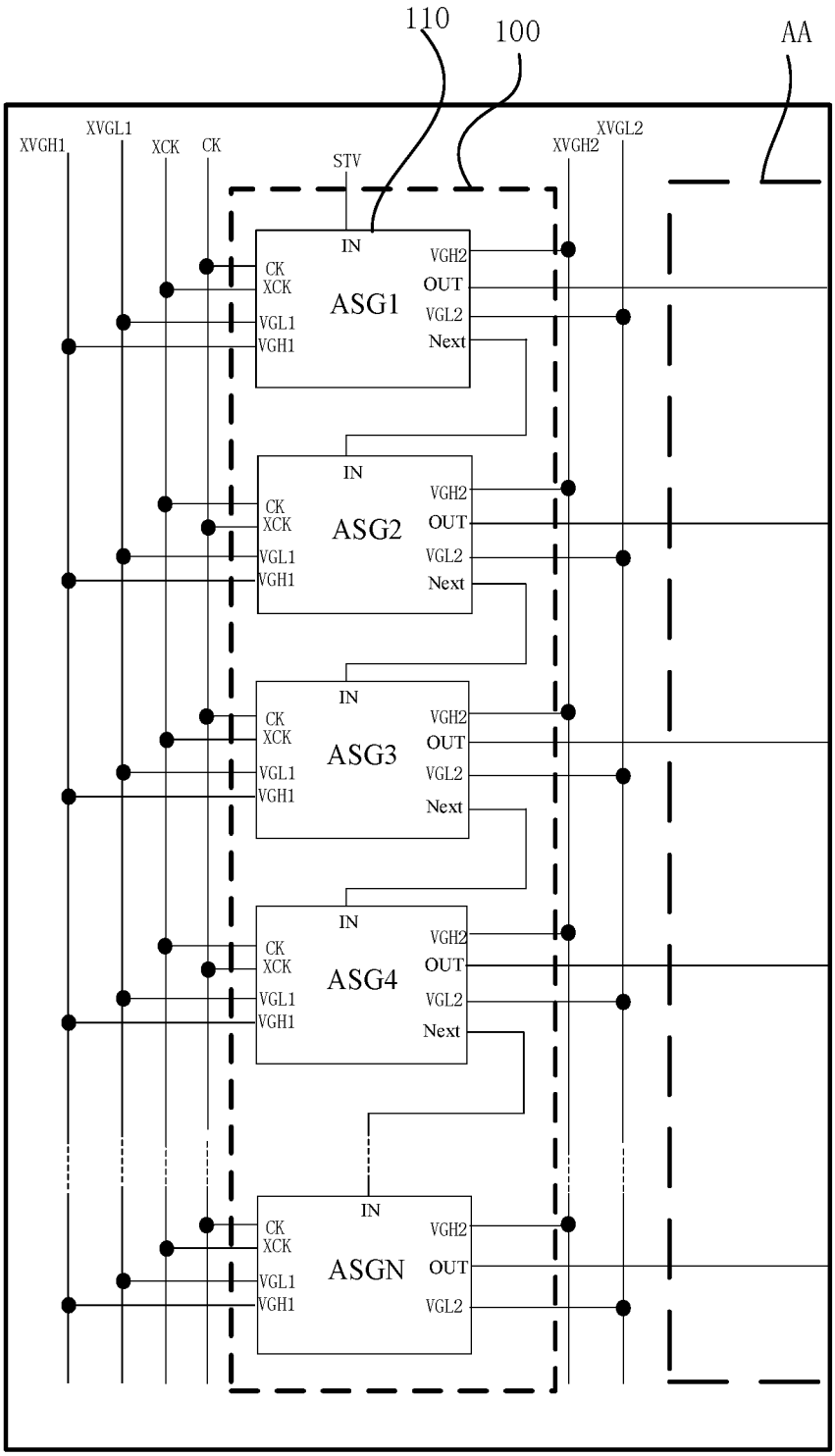
FIG. 14 illustrates a schematic diagram of a driving circuit of another exemplary display panel consistent with disclosed embodiments of the present disclosure.

FIG. 14 illustrates a schematic diagram of a driving circuit of a display panel consistent with disclosed embodiments of the present disclosure. In certain embodiments, referring to FIG. 14, the first voltage signal line XVGH1 and the second voltage signal line XVGL1 may be disposed on the side of the driving circuit facing away from the display region AA of the display panel. The third voltage signal line XVGH2 and the fourth voltage signal line XVGL2 may be disposed on the side of the driving circuit facing toward the display region AA of the display panel, to further save the space of the driving circuit 100 and shorten the length of signal line.

Because the potential of the first voltage signal VGH1 is greater than the potential of the third voltage signal VGH2, and/or the potential of the second voltage signal VGL1 is less than the potential of the fourth voltage signal VGL2, the voltage values carried on the first voltage signal line XVGH1 and the second voltage signal line XVGL1 may be larger. If line widths of the first voltage signal line XVGH1 and the second voltage signal line XVGL1 are substantially small, the resistance thereof may be substantially large, and the voltage loss thereon may be substantially large. Therefore, in one embodiment, the line width of at least one of the first voltage signal line XVGH1 and the second voltage signal line XVGL1 may be greater than the line width of at least one of the third voltage signal line XVGH2 and the fourth voltage signal line XVGL2.

In the shift register, the first transistor M1 and the second transistor M2 may generate the output signal OUT. The first transistor M1 and the second transistor M2 may often be transistors with a substantially large width-to-length ratio.

Figure 15:
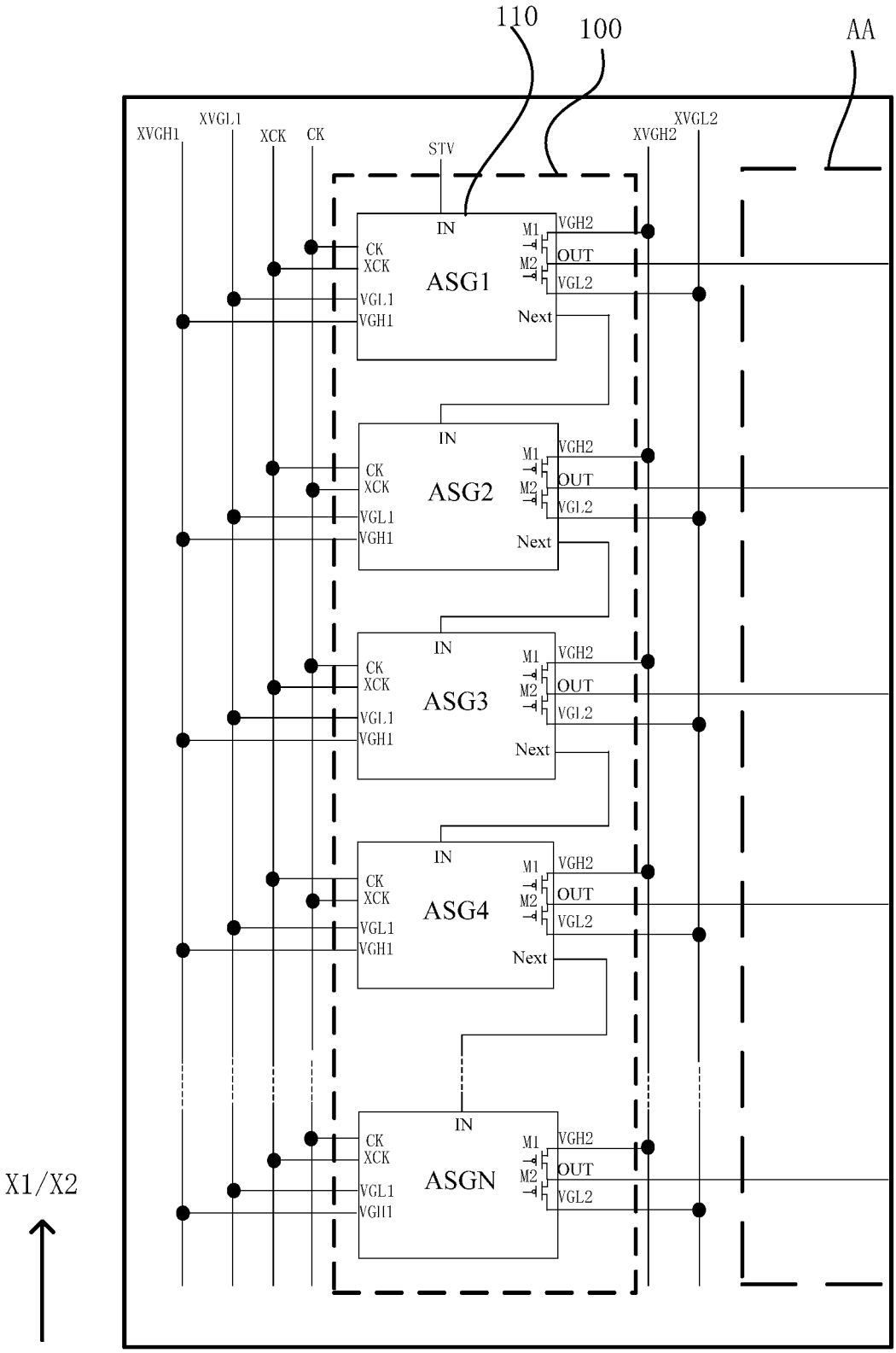
FIG. 15 illustrates a schematic diagram of a driving circuit of another exemplary display panel consistent with disclosed embodiments of the present disclosure.

FIG. 15 illustrates a schematic diagram of a driving circuit of a display panel consistent with disclosed embodiments of the present disclosure. Therefore, to further reduce the frame of the display panel and reduce the space of the driving circuit 100, in one embodiment, referring to FIG. 15, the shift registers 110 may be cascaded with each other along a first direction X1, and the first transistor M1 and the second transistors M2 may be arranged along a second direction X2, where the first direction X1 may be parallel to the second direction X2.

Referring to FIG. 1, in one embodiment, the display panel may include a pixel circuit 210. The driving circuit 100 may provide a first driving signal to the pixel circuit 210 through a first driving signal line 120, and the first driving signal may be the output signal OUT.

Figure 16:
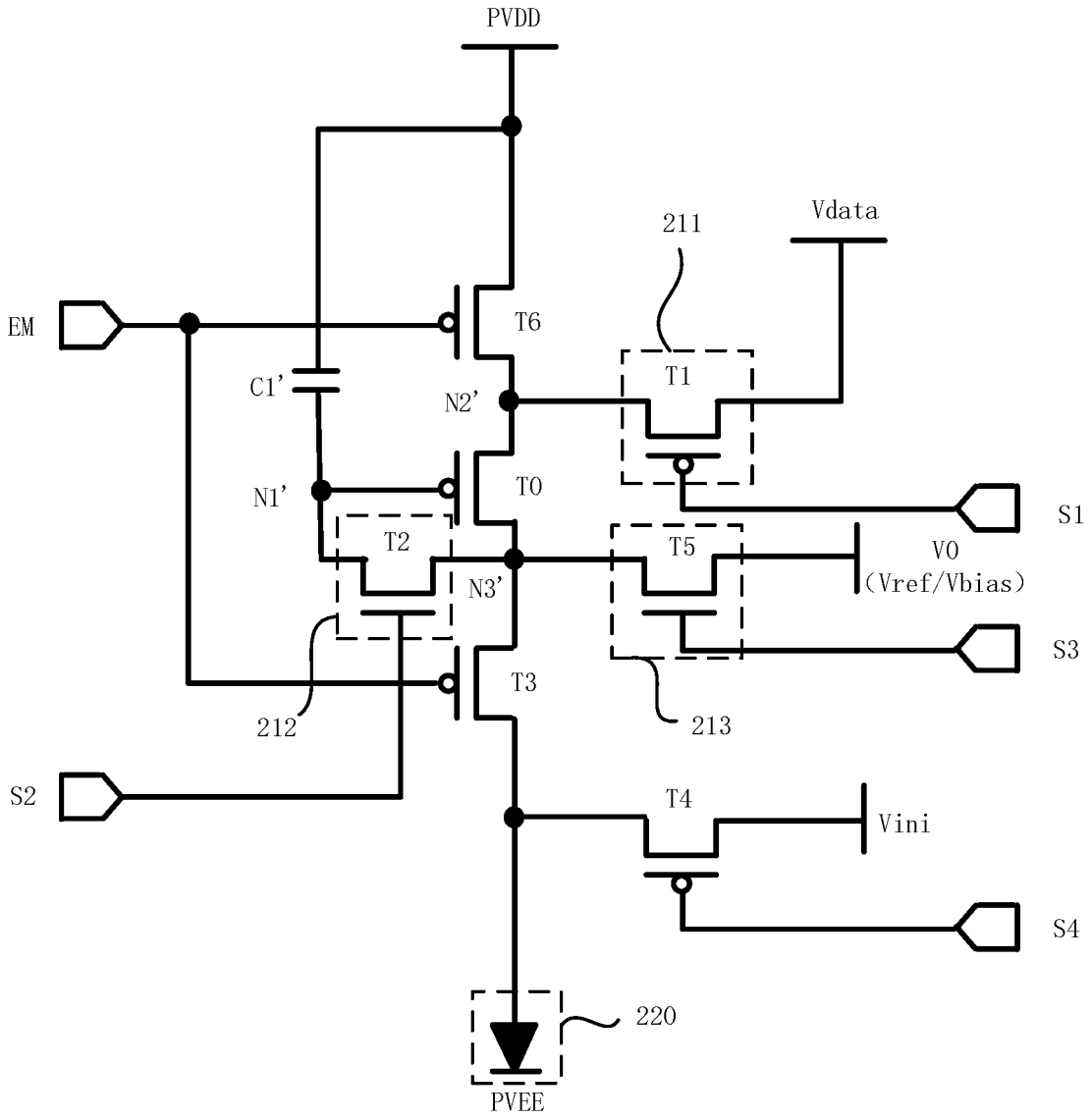
FIG. 16 illustrates a schematic diagram of a pixel circuit of an exemplary display panel consistent with disclosed embodiments of the present disclosure.
Figure 17:
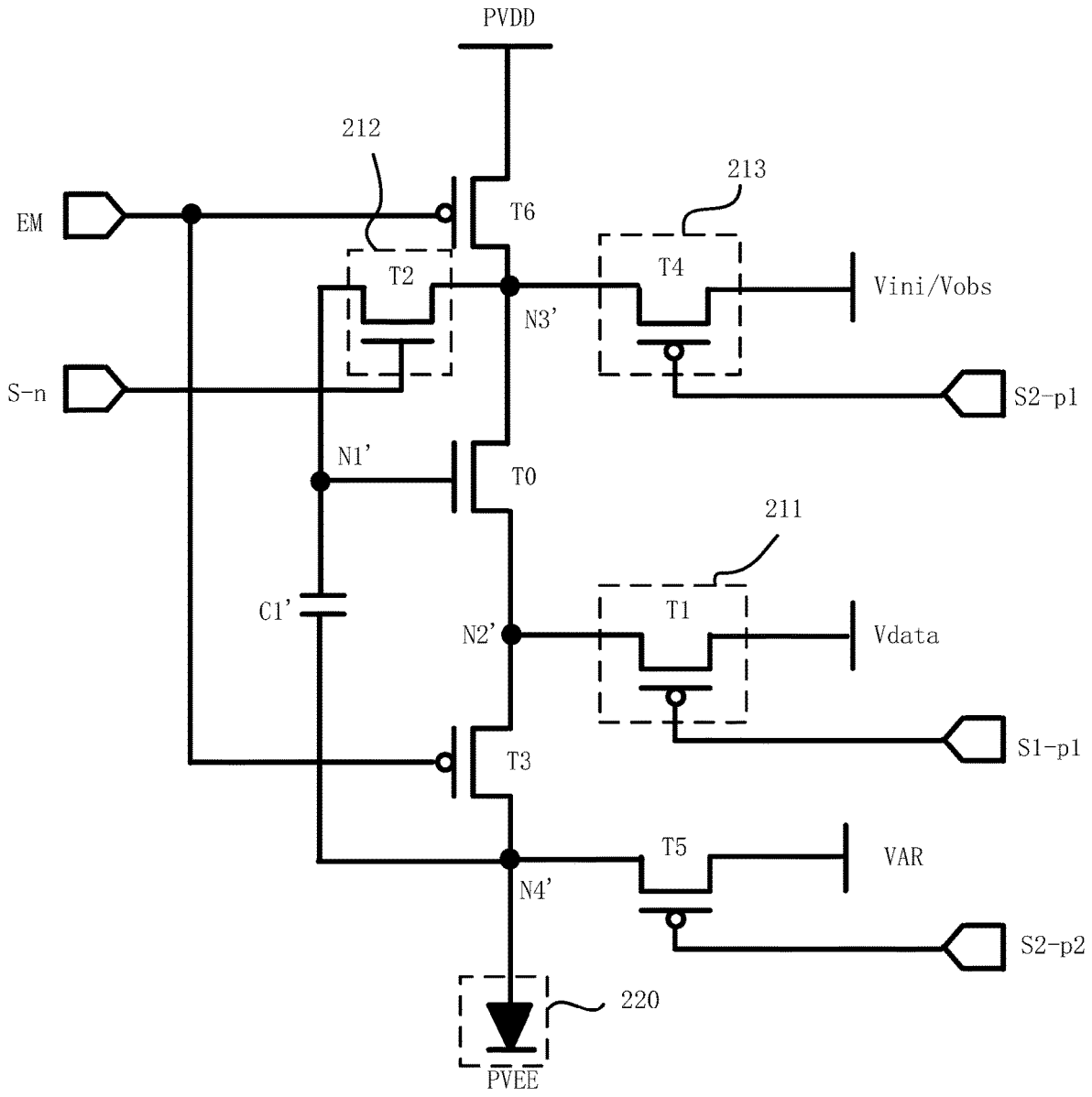
FIG. 17 illustrates a schematic diagram of a pixel circuit of another exemplary display panel consistent with disclosed embodiments of the present disclosure.

FIG. 16 illustrates a schematic diagram of a pixel circuit of a display panel consistent with disclosed embodiments of the present disclosure; and FIG. 17 illustrates a schematic diagram of a pixel circuit of another display panel consistent with disclosed embodiments of the present disclosure. Referring to FIG. 16 and FIG. 17, the pixel circuit may include a driving transistor T0. The driving transistor T0 in FIG. 16 may be a PMOS transistor, and the driving transistor T0 in FIG. 17 may be an NMOS transistor. The pixel driving circuit may further include other transistors T1-T6 and other signal input terminals, which may not be repeated herein.

The gate of the driving transistor T0 may be coupled to the first driving signal line 120. The first driving signal, i.e., the output signal OUT of the shift register, may be configured to selectively reset the gate of the driving transistor T0 and to initialize the gate of the driving transistor T0.

The output signal OUT of the shift register may be V0 (Vref/Vbias) in FIG. 16. When the transistor T5 and the transistor T2 are turned on, the output signal OUT of the shift register, i.e., V0 (Vref/Vbias), may be transmitted to the gate of the driving transistor T0, to reset the gate of the driving transistor T0.

The output signal OUT of the shift register may be Vobs/Vini in FIG. 17. When the transistor T4 and the transistor T2 are turned on, the output signal OUT of the shift register, i.e., Vobs/Vini, may be transmitted to the gate of the driving transistor T0, to reset the gate of the driving transistor T0.

When the driving transistor T0 is a PMOS transistor, resetting the gate may mainly include providing a low-level signal for the gate. However, to achieve high-frequency refresh of the display panel, a gate reset signal may not be too low, to shorten the charging period of the node N1' in a data writing stage in FIG. 16. Therefore, an absolute voltage value VGL2 of the fourth voltage signal VGL2 may need to be set substantially small. An absolute voltage value VGH2 of the third voltage signal VGH2 may correspond to the non-reset stage, and may be required to be at a substantially high level to ensure that during the non-reset stage, the gate of the driving transistor T0 may be prevented from being affected by such signal. Therefore, for the PMOS transistor, VGH2 may be set appropriately high. For an NMOS transistor, the level situation may be opposite, while the principle may be the same.

Based on this, optionally, an absolute voltage value of the first voltage signal VGH1 may be VGH1, an absolute voltage value of the second voltage signal VGL1 may be VGL1, the absolute voltage value of the third voltage signal VGH2 may be VGH2, and the absolute voltage value of the fourth voltage signal VGL2 may be VGL2. When the driving transistor T0 is a PMOS transistor, $|V_{GH1}-V_{GH2}|\leq|V_{GL1}-V_{GL2}|$. Alternatively, when the driving transistor T0 is an NMOS transistor, $|V_{GH1}-V_{GH2}|\geq|V_{GL1}-V_{GL2}|$.

Furthermore, for a PMOS transistor, if $V_{GL1}-V_{GL2}|\geq V_{GL2}$, for example, $V_{GH1}$ is 9V and $V_{GL2}$ is 4V, then $|V_{GL1}-V_{GL2}|$ may be larger than $V_{GL2}$, in the reset stage, the gate potential of driving transistor T0 may not be too low, which may ensure the smooth operation of the driving transistor T0. For an NMOS transistor, the level situation may be opposite, while the principle may be the same.

Based on this, optionally, when the driving transistor T0 is a PMOS transistor, $|V_{GH1}-V_{GH2}|\leq V_{GH2}$ and $|V_{GL1}-V_{GL2}|\geq V_{GL2}$. Alternatively, when the driving transistor is an NMOS transistor, $|V_{GH1}-V_{GH2}|\geq V_{GH2}$ and $|V_{GL1}-V_{GL2}|\leq V_{GL2}$.

Referring to FIG. 16 and FIG. 17, in one embodiment, the pixel circuit may include a data writing unit 211, a compensation unit 212, and a reset unit 213. The data writing unit 211 may be connected to the source of the driving transistor T0. The compensation unit 212 may be connected between the gate and the drain of the driving transistor T0. The reset unit 213 may be connected to the drain of the driving transistor T0.

The working process of the pixel circuit may include a reset stage and a bias stage. In the reset stage, both the reset unit 213 and the compensation unit 212 may be turned on, and the gate of the driving transistor T0 may receive the reset signal. In the bias stage, the reset unit 213 may be turned on and the compensation unit 212 may be turned off, and the drain of the driving transistor T0 may receive the bias signal.

Specifically, when the output signal OUT of the shift register is V0 (Vref/Vbias) in FIG. 16, in the reset stage, the output signal OUT, i.e., the reset signal, may be configured to reset the gate of the driving transistor T0. In the bias stage, the reset unit 213 may be turned on, and the output signal OUT, i.e., the bias signal, may be configured to charge the node N3' in FIG. 16, such that the potential of the node N3' in FIG. 16 may be greater than the potential of the node N1' in FIG. 16, to avoid a leakage current flowing from the node N1' to the node N3' in the driving transistor T0. The leakage current may cause the potential of the node N1' to drop, and may affect the display of the display panel.

When the output signal OUT of the shift register is Vobs/Vini in FIG. 17, in the reset stage, the output signal OUT, i.e., the reset signal, may be configured to reset the gate of the driving transistor T0. In the bias stage, the output signal OUT, i.e., the bias signal, may be configured to adjust the potential of the node N3' in FIG. 17, such that the potential of the node N3' in FIG. 17 may be less than the potential of the node N1' in FIG. 17. The difference between embodiments associated with FIG. 16 and FIG. 17 may include that the reset signal and the bias signal may be at different levels.

Referring to FIG. 16, in one embodiment, the reset signal may be the fourth voltage signal VGL2, and the bias signal may be the third voltage signal VGH2. In other words, the reset signal may be the output signal OUT generated by the fourth voltage signal VGL2, and the bias signal may be the output signal OUT generated by the third voltage signal VGH2.

Specifically, in the light-emitting stage of the pixel circuit shown in FIG. 16, there may be a situation where the potential of the node N1' (gate) of the driving transistor T0 may be greater than the potential of the node N3' (drain) of the driving transistor T0. For example, the potential of node N2' may be 4.6V, the potential of node N1' may be 3V, and the potential of node N3' may be 2V. For a PMOS transistor, after being maintained at such situation for a substantially long period, the stability of the PMOS transistor may be affected. Therefore, the bias stage may need to be set in the non-light-emitting stage, by raising the potential of the node N3' through the bias signal, the above effect in the light-emitting stage may be eliminated. To fully achieve such process, the high-level signal VGH2 of the bias signal may need to be as high as possible, while the low-level signal VGL2 of the reset signal may not need to be set too low, and, thus, $|V_{GH1}-V_{GH2}|\leq|V_{GL1}-V_{GL2}|$.

Referring to FIG. 17, the driving transistor may be an NMOS transistor, the reset signal may be the third voltage signal VGH2, and the bias signal may be the fourth voltage signal VGL2. In other words, the reset signal may be the output signal OUT generated by the third voltage signal VGH2, and the bias signal may be the output signal OUT generated by the fourth voltage signal VGL2.

Specifically, in the light-emitting stage of the pixel circuit shown in FIG. 17, there may be a situation where the potential of the node N1' (gate) of the driving transistor T0 may be less than the potential of the node N3' (drain) of the driving transistor T0. For example, the potential of node N3' may be 4.6V, and the potential of node N1' may be 3V. For an NMOS transistor, after being maintained at such situation for a substantially long period, the stability of the NMOS transistor may be affected. Therefore, the bias stage may need to be set in the non-light-emitting stage, by pulling down the potential of the node N3' through the bias signal, the above effect in the light-emitting stage may be eliminated. To fully achieve such process, the low-level signal VGL2 of the bias signal may need to be set as low as possible, while the high-level signal VGH2 of the reset signal may not need to be set too low, and, thus, $|V_{GH1}-V_{GH2}|\geq|V_{GL1}-V_{GL2}$.

Figure 18:
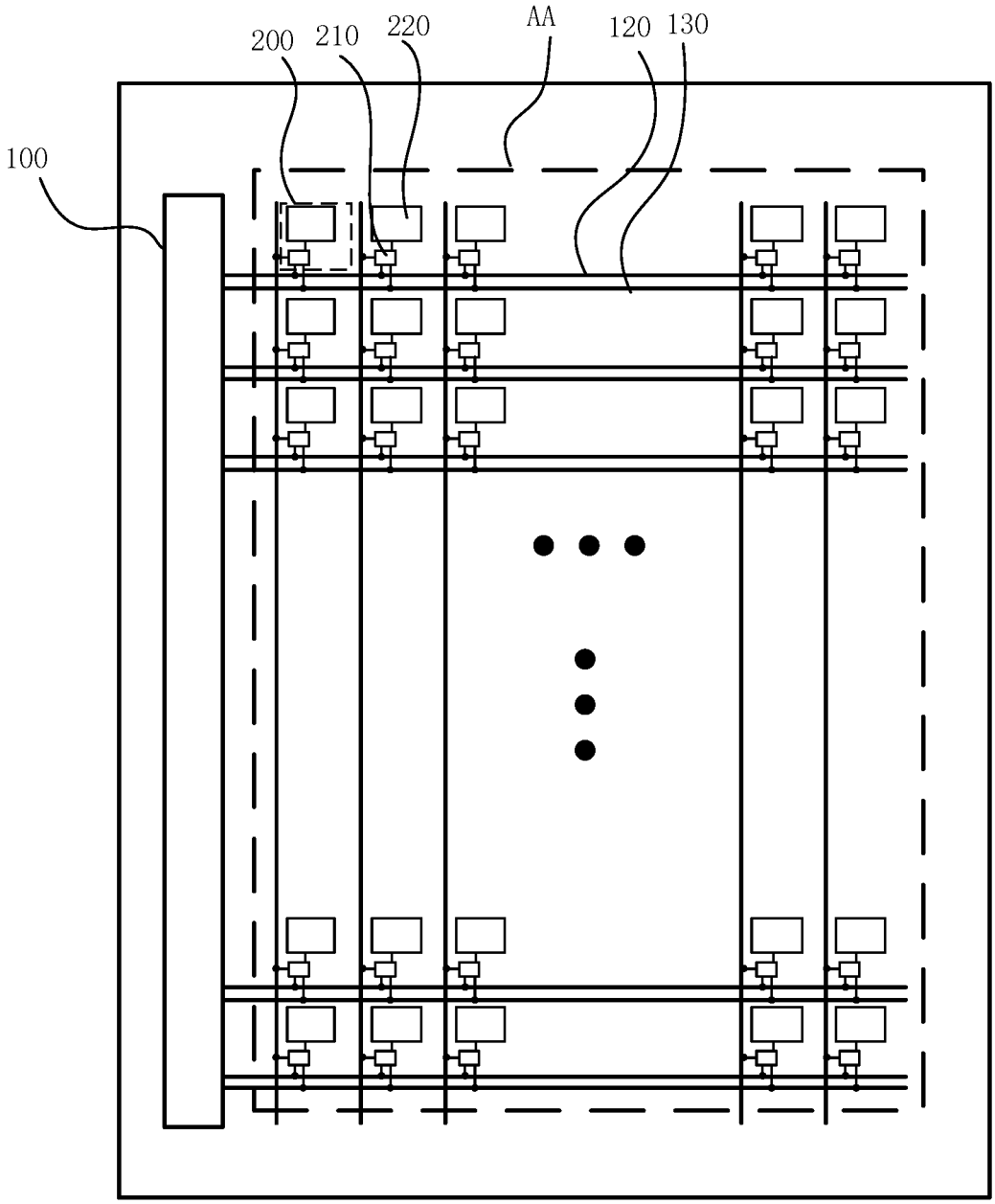
FIG. 18 illustrates a schematic top-view of another exemplary display panel consistent with disclosed embodiments of the present disclosure.

FIG. 18 illustrates a schematic top-view of another display panel consistent with disclosed embodiments of the present disclosure. Referring to FIG. 18, in one embodiment, the display panel may further include a light-emitting element 220. The light-emitting element 220 may include a cathode, an anode, and a light-emitting layer disposed between the cathode and the anode. The driving circuit 100 may provide a second driving signal to the pixel circuit 210 through a second driving signal line 130, and the second driving signal may be the output signal OUT.

The anode of the light-emitting element 220 may be coupled to the second driving signal line 130, and the second driving signal, i.e., the output signal OUT, may be configured to selectively reset the light-emitting element 220.

Specifically, the output signal OUT of the shift register may be Vini in FIG. 16. When the transistor T4 is turned on, the output signal OUT of the shift register, i.e., Vini, may be transmitted to the anode of the light-emitting element 220, to reset the anode of the light-emitting element 220.

In another embodiment, the output signal OUT of the shift register may be VAR in FIG. 17. When the transistor T5 is turned on, the output signal OUT of the shift register, i.e., VAR, may be transmitted to the anode of the light-emitting element 220, to reset the anode of the light-emitting element 220.

In one embodiment, the absolute voltage value of the first voltage signal VGH1 may be $V_{GH1}$, the absolute voltage value of the second voltage signal VGL1 may be $V_{GL1}$, the absolute voltage value of the third voltage signal VGH2 may be $V_{GH2}$, and the absolute voltage value of the fourth voltage signal VGL2 may be $V_{GL2}$. In one embodiment, the reset signal of the anode of the light-emitting element 220 may often be at a low level, $|V_{GH1}-V_{GH2}|\leq|V_{GL1}-V_{GL2}|$.

In addition, in certain application scenarios, the potential of the reset signal may not be too low, $|V_{GH1}-V_{GH2}|\leq V_{GH2}$ and $|V_{GL1}-V_{GL2}|\geq V_{GL2}$.

Figure 19:
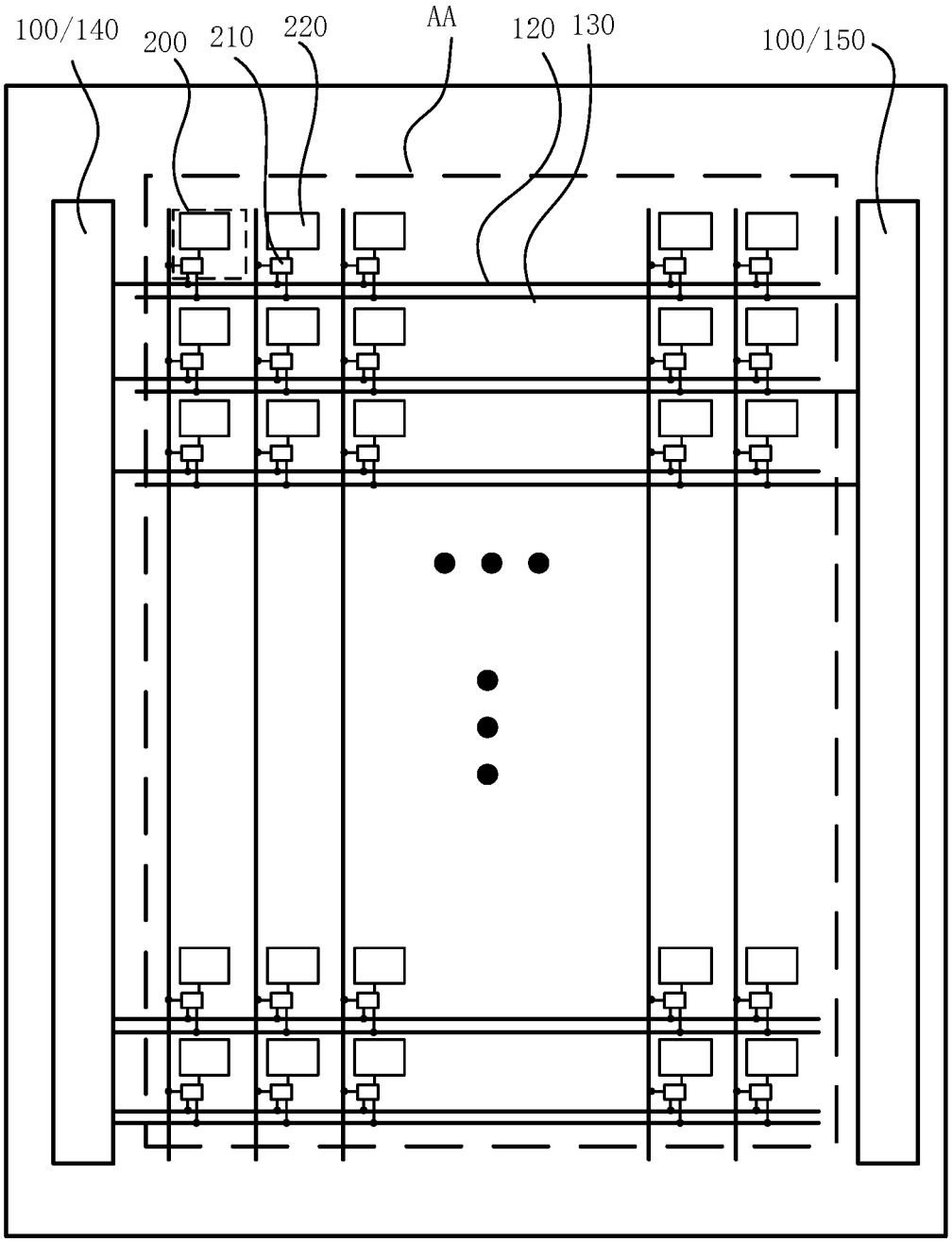
FIG. 19 illustrates a schematic top-view of another exemplary display panel consistent with disclosed embodiments of the present disclosure.

In the above embodiments, for illustrative purposes, the display panel may merely include one driving circuit as an example, which may not be limited by the present disclosure. FIG. 19 illustrates a schematic top-view of another display panel consistent with disclosed embodiments of the present disclosure. In one embodiment, referring to FIG. 19, the display panel may include a first driving circuit 140 and a second driving circuit 150. The first driving circuit 140 may include N1-level shift registers cascaded with each other, and the second driving circuit 150 may include N2-level shift registers cascaded with each other, where N1≥2, and N2≥2.

The potential of the third voltage signal in the first driving circuit 140 may be different from the potential of the third voltage signal in the second driving circuit 150; and/or, the potential of the fourth voltage signal in the first driving circuit 140 may be different from the potential of the fourth voltage signal in the second driving circuit 150, such that the output signal of the first driving circuit 140 may have a voltage different from the output signal of the second driving circuit 150, to meet the demands of the pixel circuit 210 for different signals with different voltages.

Referring to FIG. 19, in one embodiment, the display panel may further include the pixel circuit 210. The first driving circuit 140 may provide a third driving signal for the pixel circuit 210, and the second driving circuit 150 may provide a fourth driving signal for the pixel circuit 210. In other words, the output signal of the first driving circuit 140 may be the third driving signal of the pixel circuit 210, and the output signal of the second driving circuit 150 may be the fourth driving signal of the pixel circuit 210. The third driving signal and the fourth driving signal may be different driving signals, e.g., reset signals with different voltages, to meet the demands of the pixel circuit 210 for different signals with different voltages. In certain embodiments, the third driving signal and the fourth driving signal may be signals with different timings, to provide the pixel circuit 210 with two signals with different timings. For example, one of the third driving signal and the fourth driving signal may be a reset signal, and the other one of the third driving signal and the fourth driving signal may be a scan signal.

Figure 20:
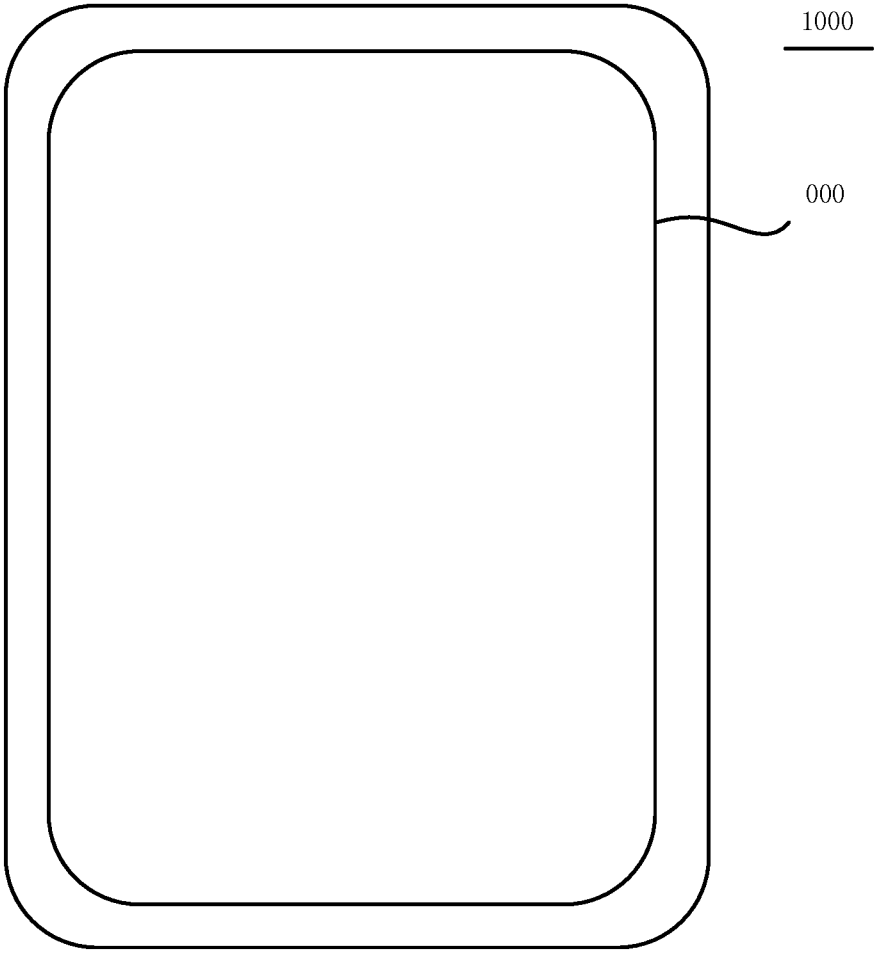
FIG. 20 illustrates a schematic diagram of an exemplary display device consistent with disclosed embodiments of the present disclosure.

The present disclosure also provides a display device. FIG. 20 illustrates a schematic diagram of a display device consistent with disclosed embodiments of the present disclosure. Referring to FIG. 20, the display device 1000 may include a display panel 000 provided in any of the above-disclosed embodiments of the present disclosure. For illustrative purposes, the display device 1000 as a mobile phone in embodiment associated with FIG. 20 may be described in detail as an example. It should be understood that the display device 1000 in the present disclosure may be a computer, a TV, a vehicle-mounted display device, or any other display device with a display function, which may not be limited by the present disclosure. The display device 1000 in the present disclosure may have the beneficial effects of the display panel in the present disclosure, which may refer to specific descriptions of the display panel in the foregoing embodiments, and may not be repeated herein.

The disclosed display panel and display device may have following beneficial effects. In the disclosed display panel, based on the input signal, the first clock signal, the second clock signal, the first voltage signal and the second voltage signal, the signal of the second node and the signal of the fourth node may be controlled through the first control unit, the second control unit, and the third control unit. The fourth control unit may be configured to receive the third voltage signal and the fourth voltage signal, and in response to the signal of the second node and the signal of the fourth node controlled by the first control unit, the second control unit and the third control unit, generate the output signal. In other words, the first control unit, the second control unit, and the third control unit may be a control part of the shift register. The fourth control unit may be an output part of the shift register and may be configured to generate the output signal.

The voltage signals (the third voltage signal and the fourth voltage signal) received by the fourth control unit and the voltage signals (the first voltage signal and the second voltage signal) received by the first control unit, the second control unit, and the third control unit may be set respectively. In other words, the voltage signals of the control part and the voltage signals of the output part of the shift register may be set respectively, such that the voltage signals received by the fourth control unit may be set directed to the requirements of the pixel circuit in the display panel for different signals, and the required signal may be selectively outputted, which may improve the flexibility of the signals outputted by the driving circuit.

Moreover, because the potential of the first voltage signal is greater than the potential of the third voltage signal, and/or the potential of the second voltage signal is less than the potential of the fourth voltage signal, the waveform stability of the output signal generated by the fourth control unit may increase, which may improve the stability of the signal outputted by the driving circuit.

The description of the disclosed embodiments is provided to illustrate the present disclosure to those skilled in the art. Various modifications to these embodiments will be readily apparent to those skilled in the art, and the generic principles defined herein may be applied to other embodiments without departing from the spirit or scope of the disclosure. Thus, the present disclosure is not intended to be limited to the embodiments illustrated herein but is to be accorded the widest scope consistent with the principles and novel features disclosed herein.

What is claimed is:

1. A display panel, comprising:

a driving circuit, wherein:

the driving circuit includes N-level shift registers cascaded with each other, wherein N is greater than or equal to two, and a shift register of the N-level shift registers includes:

a third control unit, configured to control a signal of a fourth node, the third control unit receives a first voltage signal and a second voltage signal, the first voltage signal is a high-level signal, and the second voltage signal is a low-level signal; and a fourth control unit, configured to generate an output signal, the fourth control unit receives a third voltage signal and a fourth voltage signal, and the third voltage signal is a high-level signal, and the fourth voltage signal is a low-level signal, wherein the fourth control unit further includes a first capacitor, a first plate of the first capacitor being connected to one of the first voltage signal, the second voltage signal, the third voltage signal and the fourth voltage signal, and a second plate of the first capacitor being connected to the fourth node.

2. The display panel according to claim 1, wherein:

a potential of the first voltage signal is greater than a potential of the third voltage signal, and/or a potential of the second voltage signal is less than a potential of the fourth voltage signal.

3. The display panel according to claim 1, wherein:

the display panel includes a first driving circuit and a second driving circuit, wherein:

the first driving circuit includes N1-level shift registers cascaded with each other, and the second driving circuit includes N2-level shift registers cascaded with each other, wherein N1 is greater than or equal to two, and N2 is greater than or equal to two, one of a potential of the third voltage signal in the first driving circuit and a potential of the third voltage signal in the second driving circuit is greater than the other one of the potential of the third voltage signal in the first driving circuit and the potential of the third voltage signal in the second driving circuit, and/or one of a potential of the fourth voltage signal in the first driving circuit and a potential of the fourth voltage signal in the second driving circuit is less than the other one of the potential of the fourth voltage signal in the first driving circuit and the potential of the fourth voltage signal in the second driving circuit.

4. The display panel according to claim 3, wherein:

the display panel further includes a pixel circuit, wherein:

the first driving circuit provides a third driving signal for the pixel circuit, the second driving circuit provides a fourth driving signal for the pixel circuit, and the third driving signal and the fourth driving signal are different driving signals.

5. The display panel according to claim 1, wherein:

the fourth control unit includes a first transistor and a second transistor, wherein:

the first transistor receives the third voltage signal, and the second transistor receives the fourth voltage signal, for the fourth control unit to generate the output signal.

6. The display panel according to claim 5, wherein:

both the first transistor and the second transistor are PMOS transistors;

a source of the first transistor is connected to the third voltage signal, a drain of the first transistor is connected to the output signal, and a gate of the first transistor is connected to the fourth node; and a source of the second transistor is connected to the fourth voltage signal, a drain of the second transistor is connected to the output signal, and a gate of the second transistor is connected to a second node, or a source of the first transistor is connected to the third voltage signal, a drain of the first transistor is connected to the output signal, and a gate of the second transistor is connected to the second node, a source of the second transistor is connected to the fourth voltage signal, a drain of the second transistor is connected to the output signal, and a gate of the second transistor is connected to the fourth node.

7. The display panel according to claim 5, wherein:

both the first transistor and the second transistor are NMOS transistors;

a source of the first transistor is connected to the third voltage signal, a drain of the first transistor is connected to the output signal, and a gate of the first transistor is connected to the second node; and a source of the second transistor is connected to the fourth voltage signal, a drain of the second transistor is connected to the output signal, and a gate of the second transistor is connected to the fourth node, or a source of the first transistor is connected to the third voltage signal, a drain of the first transistor is connected to the output signal, and a gate of the first transistor is connected to the fourth node; and a source of the second transistor is connected to the fourth voltage signal, a drain of the second transistor is connected to the output signal, and a gate of the second transistor is connected to the second node.

8. The display panel according to claim 5, wherein:

a width-to-length ratio of a channel region of the second transistor is greater than or equal to a width-to-length ratio of a channel region of the first transistor.

9. The display panel according to claim 1, wherein:

in the N-level shift registers of the driving circuit, a signal of the fourth node of a $M^{th}$-level shift register is connected to an input signal terminal of a $(M+1)^{th}$-level shift register as an input signal of the $(M+1)^{th}$-level shift register, wherein M is greater than or equal to one and less than or equal to N.

10. The display panel according to claim 1, wherein the shift register of the N-level shift registers further includes:

a first control unit, configured to control a signal of a first node, the first node being connected with a third node, a second control unit, configured to control a signal of a second node, wherein:

the third control unit, configured to receive the first voltage signal and the second voltage signal and control the signal of the fourth node in response to the signal of the second node and a signal of the third node, and the fourth control unit is configured to receive the third voltage signal and a fourth voltage signal, and generate the output signal in response to the signal of the second node and the signal of the fourth node.

11. The display panel according to claim 10, wherein:

the fourth control unit further includes a second capacitor, wherein:

a first plate of the second capacitor is connected to the second node, and a second plate of the second capacitor is connected to one of the first voltage signal, the second voltage signal, the third voltage signal and the fourth voltage signal.

12. The display panel according to claim 11, wherein:

a capacitance value of the first capacitor is less than or equal to a capacitance value of the second capacitor.

13. The display panel according to claim 11, wherein:

the second control unit includes a fifth capacitor, and a first plate of the fifth capacitor is connected to a fifth node, and a second plate of the fifth capacitor is connected to a sixth node, wherein:

a capacitance value of the fifth capacitor is less than a capacitance value of the first capacitor, and/or the capacitance value of the fifth capacitor is less than a capacitance value of the second capacitor.

14. The display panel according to claim 11, wherein:

the first control unit is configured to receive an input signal and control the signal of the first node in response to a first clock signal, the second control unit is configured to receive the first voltage signal and the second voltage signal, and control the signal of the second node in response to the signal of the first node, the first clock signal, and a second clock signal.

15. The display panel according to claim 14, wherein:

the third control unit further includes:

a third capacitor, wherein a first plate of the third capacitor is connected to the first voltage signal, and a second plate of the third capacitor is connected to the second node, and a fourth capacitor, wherein a first plate of the fourth capacitor is connected to the second clock signal or the second voltage signal, and a second plate of the fourth capacitor is connected to the third node, wherein:

both a capacitance value of the first capacitor and a capacitance value of the second capacitor are greater than a capacitance value of the third capacitor and further greater than a capacitance value of the fourth capacitor.

16. The display panel according to claim 15, wherein:

the second control unit includes a fifth capacitor, and a first plate of the fifth capacitor is connected to a fifth node, and a second plate of the fifth capacitor is connected to a sixth node, wherein a capacitance value of the fifth capacitor is less than the capacitance value of the third capacitor, and/or the capacitance value of the fifth capacitor is less than the capacitance value of the fourth capacitor.

17. The display panel according to claim 10, wherein:

the third control unit includes:

a third transistor, wherein a source of the third transistor is connected to the first voltage signal, a drain of the third transistor is connected to the fourth node, and a gate of the third transistor is connected to the second node, and a fourth transistor, wherein a source of the fourth transistor is connected to the second voltage signal, a drain of the fourth transistor is connected to the fourth node, and a gate of the fourth transistor is connected to the third node, wherein:

a width-to-length ratio of a channel region of the first transistor is greater than a width-to-length ratio of a channel region of the third transistor, or a width-to-length ratio of a channel region of the second transistor is greater than a width-to-length ratio of a channel region of the fourth transistor.

18. The display panel according to claim 14, wherein:

the first control unit includes a fifth transistor, wherein a source of the fifth transistor is connected to the input signal, a drain of the fifth transistor is connected to the first node, and a gate of the fifth transistor is connected to the first clock signal; and the second control unit includes a sixth transistor, a seventh transistor, an eighth transistor, a ninth transistor, a tenth transistor, an eleventh transistor, a twelfth transistor, and a fifth capacitor, wherein:

a source of the sixth transistor is connected to the first node, a drain of the sixth transistor is connected to a drain of the seventh transistor, and a gate of the sixth transistor is connected to the second clock signal, a source of the seventh transistor is connected to the first voltage signal, the drain of the seventh transistor is connected to the drain of the sixth transistor, and a gate of the seventh transistor is connected to a fifth node, a source of the eighth transistor is connected to the first clock signal, a drain of the eighth transistor is connected to the fifth node, and a gate of the eighth transistor is connected to the first node, a source of the ninth transistor is connected to the second clock signal, a drain of the ninth transistor is connected to the fifth node, and a gate of the ninth transistor is connected to the first clock signal, a source of the tenth transistor is connected to the second clock signal, a drain of the tenth transistor is connected to a sixth node, and a gate of the tenth transistor is connected to the fifth node, a source of the eleventh transistor is connected to the sixth node, a drain of the eleventh transistor is connected to the second node, and a gate of the eleventh transistor is connected to the second clock signal, a source of the twelfth transistor is connected to the first voltage signal, a drain of the twelfth transistor is connected to the second node, and a gate of the twelfth transistor is connected to the third node, and a first plate of the fifth capacitor is connected to the fifth node, and a second plate of the fifth capacitor is connected to the sixth node.

19. The display panel according to claim 18, wherein:

the second control unit further includes:

a thirteenth transistor, wherein a source of the thirteenth transistor is connected to the fifth node, a drain of the thirteenth transistor is connected to the gate of the tenth transistor, and a gate of the thirteenth transistor is connected to the second voltage signal, and a fourteenth transistor, wherein a source of the fourteenth transistor is connected to the first node, a drain of the fourteenth transistor is connected to the third node, and a gate of the fourteenth transistor is connected to the second voltage signal.

20. A display device, comprising a display panel, wherein the display panel includes:

a driving circuit, wherein:

the driving circuit includes N-level shift registers cascaded with each other, wherein N is greater than or equal to two, and a shift register of the N-level shift registers includes:

a third control unit, configured to control a signal of a fourth node, the third control unit receives a first voltage signal and a second voltage signal, the first voltage signal is a high-level signal, and the second voltage signal is a low-level signal; and a fourth control unit, configured to generate an output signal, the fourth control unit receives a third voltage signal and a fourth voltage signal, and the third voltage signal is a high-level signal, and the fourth voltage signal is a low-level signal, wherein the fourth control unit further includes a first capacitor, a first plate of the first capacitor being connected to one of the first voltage signal, the second voltage signal, the third voltage signal and the fourth voltage signal, and a second plate of the first capacitor being connected to the fourth node.

* * * * *